US011253760B2

(12) United States Patent
Barker et al.

(10) Patent No.: US 11,253,760 B2
(45) **Date of Patent: *Feb. 22, 2022**

(54) REMOVABLE AND REATTACHABLE GOLF CLUB GRIP

(71) Applicant: Ready Grip Technologies, Inc., New York, NY (US)

(72) Inventors: David A. Barker, New York, NY (US); Jean-Paul Baudet, New York, NY (US)

(73) Assignee: READY GRIP TECHNOLOGIES, INC., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/681,230

(22) Filed: Nov. 12, 2019

(65) Prior Publication Data

US 2020/0122007 A1 Apr. 23, 2020

Related U.S. Application Data

(63) Continuation of application No. 15/821,726, filed on Nov. 22, 2017, now Pat. No. 10,500,454, which is a (Continued)

(51) Int. Cl.

| | |
|---|---|
| ***A63B 53/14*** | (2015.01) |
| ***A63B 60/14*** | (2015.01) |
| ***A63B 60/16*** | (2015.01) |

(52) U.S. Cl.

CPC ..... *A63B 53/14* (2013.01); *A63B 60/14* (2015.10); *A63B 60/16* (2015.10); *A63B 2209/10* (2013.01)

(58) Field of Classification Search

CPC ..... A63B 53/14; A63B 60/14; A63B 2209/10; A63B 60/16

See application file for complete search history.

(56) References Cited

U.S. PATENT DOCUMENTS

| | | | |
|---|---|---|---|
| 171,214 | A | 12/1875 | Cox |
| 194,219 | A | 8/1877 | Carr |

(Continued)

FOREIGN PATENT DOCUMENTS

| | | |
|---|---|---|
| JP | S58-185255 | 12/1983 |
| JP | 2002-523155 | 7/2002 |

(Continued)

OTHER PUBLICATIONS

International Search Report of PCT Application No. PCT/IB2016/01531, dated Feb. 6, 2018.

(Continued)

*Primary Examiner* — Jeffrey S Vanderveen

(74) *Attorney, Agent, or Firm* — Andrew J. Cochran; King & Spalding LLP

(57) ABSTRACT

Attachment of an interchangeable grip sleeve particularly suited for golf requires three basic securing movements. In the first movement, the grip is situated and secured into place on the shaft by fastening toe components at the lower, distal portion of the grip onto the shaft using an insertion tool. In the second movement, heel components of the grip are positioned onto the shaft, by either rotational torque or downward pressure, optionally using a tightening tool, which results in securing the upper, proximal portion of the grip onto the shaft. In the third movement, once both heel and toe embodiments of the grip have been fastened to the shaft, the internal core diameter of the grip is decreased in order to secure the grip to the shaft, such as by rotating or twisting the entire grip body, wherein an internal mechanism maintains the grip body in the torqued or twisted position, thereby preventing the grip body from rotating back.

21 Claims, 29 Drawing Sheets

Related U.S. Application Data continuation-in-part of application No. 15/352,410, filed on Nov. 15, 2016, now Pat. No. 9,889,357, which is a continuation of application No. PCT/IB2016/001531, filed on Sep. 23, 2016.

(56) References Cited

U.S. PATENT DOCUMENTS

| | | | | |
|---|---|---|---|---|
| 215,884 | A | 5/1879 | Corliss | |
| 378,242 | A | 2/1888 | Drude et al. | |
| 4,826,168 | A | 5/1989 | McGuire et al. | |
| 5,299,802 | A | 4/1994 | Bouchet-Lassale | |
| 5,626,527 | A | 5/1997 | Eberlein | |
| 5,653,643 | A | 8/1997 | Falone et al. | |
| 5,944,617 | A | 8/1999 | Falone et al. | |
| 6,036,607 | A | 3/2000 | Finegan | |
| 6,113,508 | A | 9/2000 | Locarno et al. | |
| 6,234,924 | B1 | 5/2001 | Washburn, Jr. | |
| 6,257,997 | B1 | 7/2001 | Doble et al. | |
| 6,361,450 | B1 | 3/2002 | Huang | |
| 6,386,989 | B1 | 5/2002 | Huang | |
| 6,923,089 | B2 | 8/2005 | Wu | |
| 7,018,302 | B2 | 3/2006 | Jacoby | |
| 7,074,135 | B2 | 7/2006 | Moore | |
| 7,399,236 | B2 | 7/2008 | Takeuchi | |
| 7,458,902 | B2 | 12/2008 | Gill | |
| 7,481,716 | B1 | 1/2009 | Johnson | |
| 7,798,911 | B2 | 9/2010 | Gill | |
| 7,963,012 | B1 | 6/2011 | Brasher et al. | |
| 8,177,658 | B1 * | 5/2012 | Johnson | A63B 53/14 473/297 |
| 8,182,361 | B2 | 5/2012 | Gill | |
| 8,419,566 | B2 | 4/2013 | Gill | |
| 8,425,344 | B2 | 4/2013 | Evans et al. | |
| 8,425,345 | B2 | 4/2013 | Wall, Jr. et al. | |
| 8,454,451 | B2 | 6/2013 | Evans et al. | |
| 8,529,367 | B2 | 9/2013 | Evans et al. | |
| 8,568,246 | B2 | 10/2013 | Wall et al. | |
| 8,591,350 | B2 | 11/2013 | Evans et al. | |
| 8,678,944 | B2 | 3/2014 | Wall, Jr. | |
| 8,852,019 | B2 | 10/2014 | Evans et al. | |
| 8,984,789 | B2 | 3/2015 | Adcock, Jr. | |
| 9,174,104 | B1 | 11/2015 | Roagacki | |
| 2004/0031127 | A1 * | 2/2004 | Chen | A63B 60/00 16/436 |
| 2005/0037901 | A1 * | 2/2005 | Keith | A63B 15/00 482/109 |
| 2008/0227562 | A1 | 9/2008 | Gill | |
| 2009/0275422 | A1 | 11/2009 | Hung | |
| 2011/0009793 | A1 * | 1/2011 | Lucero | A41D 27/20 602/62 |
| 2013/0196800 | A1 | 8/2013 | Boatwright et al. | |
| 2013/0344977 | A1 | 12/2013 | Chalifoux | |
| 2014/0171214 | A1 | 6/2014 | Wall, Jr. | |
| 2014/0194219 | A1 | 7/2014 | Pallis | |
| 2014/0215884 | A1 | 8/2014 | Adcock, Jr. | |
| 2014/0378242 | A1 * | 12/2014 | Chalifoux | A63B 60/28 473/299 |
| 2015/0231426 | A1 | 8/2015 | Chapin | |
| 2018/0093149 | A1 | 4/2018 | Barker et al. | |

FOREIGN PATENT DOCUMENTS

| | | |
|---|---|---|
| JP | 2004 243068 | 9/2004 |
| JP | 2010/253232 | 11/2011 |
| JP | 2013/009918 | 1/2013 |
| WO | WO 2011/149488 | 12/2011 |

OTHER PUBLICATIONS

International Search Report of PCT Application No. PCT/US2018/061847, dated Feb. 4, 2019.

Supplemental Search Report issued in European Patent Application No. EP 16 84 5788, dated Aug. 20, 2018.

Notice of Allowance issued for Japanese patent application No. JP 2018-514946, dated Nov. 6, 2018.

https://www.golfworks.com/the-ultimate-grip-installer-tool/p/bbgit, www.golfworks.com, Mar. 30, 2016 (Year 2016).

* cited by examiner

Heel Securing Method A

Heel Securing Method B

Heel Securing Method C

Heel Securing Method A

Heel Securing Method B

Heel Securing Method C

Toe Securing Method A

Toe Securing Method B

Toe Securing Method A

Toe Securing Method A

Toe Securing Method A

Toe Securing Method B

Toe Securing Method B

Toe Securing Method B

Toe Securing Method B

Rotational Movement #3.

Rotational Movement #3
Method A

Rotational Movement #3
Method B

Rotational Movement #3
Method C

Rotational Movement 3 Method A

Rotational Movement 3 Method B

Rotational Movement 3 Method C

Core A

Core B

Core C

Core D

Core E

Spline A

Spline B

Spline C

Spline D

Spline E

REMOVABLE AND REATTACHABLE GOLF CLUB GRIP

CROSS-REFERENCE TO RELATED APPLICATIONS

This application is a continuation of U.S. patent application Ser. No. 15/821,726, filed Nov. 22, 2017, now U.S. Pat. No. 10,500,454, issued Dec. 10, 2019, which is a continuation-in-part of U.S. patent application Ser. No. 15/352,410, filed Nov. 15, 2016, now U.S. Pat. No. 9,889,357, issued Feb. 13, 2018, which is a continuation of International Patent Application No. PCT/IB2016/001531, filed Sep. 23, 2016, which claimed priority from U.S. Provisional Patent Application No. 62/219,752, filed Sep. 17, 2015; the entire contents of each of the foregoing patent applications is incorporated herein by reference.

FIELD OF THE INVENTION

The present invention relates generally to hand held gripping surfaces that may be placed on and removed from any tubular shaft. Without limitation, the grip is generally related to sporting industries. More specifically, the present invention relates to the field of removable and re-attachable grips, and more particularly to an apparatus, device and system for removing and re-attaching grips on golf clubs or other tubular shafts.

BACKGROUND OF THE INVENTION

Typically, grips are made from a flexible material such as, for example, rubber, silicone rubber, or elastomer composites. These materials help a golfer grip the shaft during play, but, over time, they wear down and lose their efficacy.

Good golfing practice requires a golfer to change the grips on his/her golf club as it wears and loses its ability to function optimally. Golfers may have their clubs professionally re-griped or they may purchase the grips and needed materials to do it themselves.

Golf grips are conventionally attached to the club by adhering double-sided tape to the end of the club's steel or composite shaft. A solvent is then used to lubricate the taped end while the grip is forced over the shaft. The golf club shaft is typically tapered, increasing from the club head to a larger diameter at the upper grip end. In order for the grip to be fit to the golf club shaft properly, the grip must also have a taper to match the taper of the golf club shaft. The taper makes fitting the grip over the shaft challenging because, at one end, the grip has an opening that is smaller than the width of the shaft at its distal end.

Once the grip has been stretched over the shaft, the grip can be adjusted to the shaft end as the solvent and glue dries. This process is challenging because it requires excessive physical exertion to stretch the grip over the shaft even when the shaft is well lubricated by a solvent. The process of taping the shaft, lubricating the shaft and securing the club while forcing the grip on the shaft is messy and challenging to do in a home environment.

In addition, removing a worn grip requires using a blade to split the rubber along the shaft and pulling the old grip off. Cutting the grip can be dangerous, and physically pulling the grip off can be challenging. Not only is the physical process of removing conventional grips laborious and meticulous, but it can also take between 12-24 hours for the solvents to fully adhere and dry before the grip is ready for full use.

Other, more mechanical methods of removing grips exist. For example, pneumatic air pumps may be used to inflate the grip, thus allowing it to slide more easily onto and off of the shaft. However, these tools require expertise to operate. Aside from the safety risks associated with pneumatic tools, malpractice can incorrectly inflate a grip. Due to memory of the rubber material, applying too much pressure can permanently stretch the grip, thus making it unusable.

Grips that are interchangeable and more easily removed and re-attached exist in the prior art.

For example, the company, SwitchGrips (www.switchgripsusa.com) offers an interchangeable grip technology that provides a player with the ability to change the grip on a putter. Currently, it is the only interchangeable putter grip to offer multiple sizes for natural, fluid and more consistent putts. However, the internal sleeve of the grip is still required to be fixed to the shaft like conventional grips. The outer sleeve is the only changeable portion.

Accordingly, the SwitchGrips grip is not a "true" changeable grip as it is limited to a specific housing made by a specific company. Thus, the ability to attach any grip onto any shaft is not possible with this concept, which limits the product to a very small niche market.

Not only does SwitchGrips' technology not address the key issues associated with interchangeable grip technology, but it limits the user's purchasing power by restricting the user to buying only SwitchGrip products. Furthermore, SwitchGrips addresses only putter grips, and it is not possible to apply this technology to current iron or driver shafts due to the force required to swing such clubs, which is very different to that of putters. For example, the attachment of SwitchGrips' outer shell would not hold up under high torque conditions applied to iron or driver shafts. In addition, SwitchGrips acknowledges that their putter grips are not "one size fits all", which limits their technology.

Another company, Nickel Putter USA (www.nickelputterusa.com) offers grips having adjustable lengths, which is available for their current product line, and is limited to Nickel Putter products only. The adjustable grips allow for an incremental length adjustment and readjustment, and they are interchangeable. However, the grip has a glued screw in the back that is required in order to assemble the grip on the putter shaft. In order to remove the putter from the shaft, the user must heat the screw head and melt the glue. Thus, Nickel Putter's system is not only intricate, but requires tools and user experience to execute.

In addition, similar the SwithGrips' grips, Nickel Putter's grips are specific to putters and Nickel Putter products only, which limits Nickel Putter products to a small niche portion of the market.

A third company, Pure Grips USA (www.puregrips.com) is the owner of U.S. Pat. No. 7,963,012, issued Jun. 21, 2011, and entitled TOOL FOR SEATING A GRIP ON THE SHAFT OF A GOLF CLUB, which is hereby incorporated by reference herein in its entirety. Pure Grips' "Golf Grip Seating Tool" permits tapeless seating of a grip onto the shaft of a golf club by having the controllable application of compressed air expand the grip as it is positioned onto the shaft of a golf club. The "Golf Grip Seating Tool" comprises an enclosing member having an axial bore with an open end and a closed end, a slot, and a convergent nozzle mounted medially in the closed end of the enclosing member. The open end of the grip fits over the open end of the golf club shaft and forms a seal to allow the compressed air applied via the nozzle in the enclosing member to expand the grip, yet allow excess air to escape between the grip and the shaft as the grip controllably inflates at the distal end.

While Pure Grips' tool provides a fast method of application with no tape or solvents, it requires specific tools and user experience, which complicate the process of changing a grip. Furthermore, the tools require electricity to operate, which limits the location a player may change the grip, and renders rapidly replacing grips at the point of play impossible.

U.S. Pat. No. 7,458,902, issued Dec. 2, 2008, and entitled CHANGEABLE GOLF GRIP, which is hereby incorporated by reference herein in its entirety, discloses a changeable grip for a shock imparting implement grip having a body, a ferrule element, and a sleeve. The body and sleeve portions of the grip are threadably connected to the ferrule element, which is attached to the shaft of a shock imparting implement. However, this technology requires altering the golf club shaft to reduce the shaft's length, because the grip requires a mounting that is fixed to the shaft. Moreover, the application of the mounting to the shaft is not disclosed in the patent. In addition, golf shafts have a taper and thus different circumferences and diameters along the length of the golf club. The grip disclosed in U.S. Pat. No. 7,458,902 does not address this core challenge, as it would limit the invention.

U.S. Pat. No. 8,182,361, issued May 22, 2012, and entitled CHANGEABLE GRIP, which is hereby incorporated by reference herein in its entirety, discloses a changeable grip for a shock imparting implement having a gripping sleeve positioned on a handle sleeve attached to a handle. A lower end of gripping sleeve abuts a ledge integrally formed in the handle sleeve. A threaded cap compresses the gripping sleeve against the ledge to secure the grip to the handle sleeve. Optional splines on an outer surface of the handle sleeve, which mesh with channels in the gripping sleeve, function to prevent slippage or rotation during use. However, this technology requires altering the golf club shaft, similar to U.S. Pat. No. 7,458,902, which is undesirable.

U.S. Pat. No. 5,299,802, issued Apr. 5, 1994, and entitled REMOVABLE GOLF CLUB GRIP, which is hereby incorporated by reference herein in its entirety, discloses a removable grip adapted to be fixed on the existing conventional grip of a golf club, the grip has hollows and protuberances enabling the player to automatically adopt a correct position of the hands on the grip. It is noted that this removable grip is not used for play, as it fails to meet the requirements of the U.S. Golf Association (USGA). The grip is used for training purposes to learn correct placement of the user hands when swinging the golf club. The fixing mechanisms are limited, and only work because they lay over rubber and not over a metal or graphite golf club shaft, which has a slip surface.

Thus, there is a need in the market for a wider range of grips with different properties, colors, weights, and sizes. A need exists for a changeable grip having greater flexibility in selecting a specific grip for a given application, and/or for use under a wide variety of conditions, and which allows the user to select the exact type of grip needed under the given conditions for the desired application. In addition, a need exists for a removable grip that operates with the same mechanical properties as a conventional grip.

SUMMARY OF THE INVENTION

Accordingly, it is an object of the present invention to provide a golf grip specifically designed to be easily removable and attachable so as to address the issues with conventional golf grips, and to open up new markets that may assist golfers in rapidly changing their grips at the point of play. The interchangeable, removable and re-attachable grips of the present invention will fit all current club shaft diameters, including drivers, irons, and putters, thus making it a universal grip.

It is a further object of the present invention to provide a changeable grip that allows for a wide variety of features to enhance the grip, such as, for example, designing the grip weight for swing weight control, or providing multiple types of gripping surfaces with interchangeable gripping sleeves having different combinations of materials.

Another object of the present invention is to provide an interchangeable, removable and re-attachable grip that will offer numerous improvements to the conventional process of replacing golf grips as mentioned in the Background. The grip of the current invention is not limited to golf but may also pertain to other industries such as, for example, tennis, fishing, mountain biking, motor cross, lacrosse, baseball, or any other industry that may implement a changeable grip to their corresponding instruments of use.

It is another object of the present invention to provide a system and method for rapid application of changeable grips, and to open new opportunities in the grip market, which would not presently be possible due to shortcomings of current grip technology.

Rubber grips have been an industry mainstay for nearly 50 years. They are the most common grip in all of golf today, available in a myriad of compound mixes, colors and designs. The slip-on rubber grip is found on the majority of Original Equipment Manufacturer ("OEM") agreements. On every club purchased each year, a rubber golf grip is pre-installed. As these grips wear out, golfers purchase replacement grips. This invention minimizes the cost and time commitments involved in re-gripping the golf clubs, while minimizing the risk of changing the feel through re-application of tape build up. Specifically, despite investment in grip material technology, to date no one has successfully addressed rapid application of golf grips. This disclosure defines "rapid application" as the ability to install a golf grip on a shaft without any external tool; time delay while waiting for adhesive solvents to dry; and without requiring continuous set up and maintenance of underlying tape build up used for personal customization. Further, by eliminating the "permanence" of the grip application by not requiring the grip to be cut off to remove it, an additional opportunity exists to expand the golf grip market through fashion via the increased sale of colored grips that can be removed and applied at will.

Outside of the core functionality of the grips in comparison to alternatives, there are many key drivers in the golf market that will be critical in determining the financial viability of a new golf grip entering the market. The right product in the golf grip market will allow an existing golf grip manufacturer to grow market share in core markets as well as widen appeal in golf participation growth countries.

The benefits and strengths of present disclosure are outlined below:

- The rapid application of the golf grip without the use of external tooling, external substances and/or payment of services;
- Melds both utility, performance, longevity of club life and fashion into one;
- Does not substantially alter existing low cost manufacturing processes used in the current industry;
- Will not address rubber composite, as this market already includes a multitude of players with established brands;
- Addresses the substructure/mechanism in which already patented golf grip rubber technology can be applied;

To be able to easily articulate the advantages and benefits of adopting the resulting product over competitors;

Meets the needs of the majority of the golfers in the market in order ensure maximum customer acquisition and retention;

Has the ability to continuously attract new customers to maximize word of mouth reach.

There is thus provided, in accordance with an embodiment of the present invention, an interchangeable (e.g., removable, re-attachable, replaceable) golf club grip that may include, in some embodiments, a body or sleeve (e.g., a grip sleeve) that includes both a heel securing mechanism (e.g., heel components) in an upper, proximal end and a contracting toe securing mechanism (e.g., toe components) in a lower, distal end. The use of the grip according to embodiments of the current invention is separated into three different actions that are outlined in further detail herein. The grip of the current invention is intended to meet all the requirements of the U.S. Golf Association (USGA) of grip parameters.

In certain embodiments of the present invention, the method of attachment of a grip onto a golf club shaft may be broken into, for example, three basic securing movements.

In the first movement, called Securing Movement #1, heel components of the grip are first positioned onto the shaft. Securing Movement #1 can be one of several Heel Securing Movements, depending to the use of different fixing heel components, and these movements can be either rotational torque or downward pressure, both of which actions result in securing the upper, proximal portion of the gripping sleeve onto the shaft. In preferred embodiments, all heel components relating to Heel Securing Movements are required to be secured before the final Rotational Movement #3 can be performed.

In the second movement, called Securing Movement #2, once the grip is situated and secured into place on the shaft by Securing Movement #1, the grip is centered on the shaft by fastening toe components at the lower, distal portion of the grip sleeve onto the shaft. Securing Movement #2 can be one of several Toe Securing Movements, depending upon the use of different fixing toe components, and these movements are generally rotational torque or another means of securing the lower, distal portion of the gripping sleeve onto the shaft. In preferred embodiments, all toe components relating to Toe Securing Movements are required to be secured before the final Rotational Movement #3 can be performed.

While in certain embodiments, as mentioned above, Securing Movement #2 can be performed only once Securing Movement #1 has been performed, i.e., once the toe components have been fastened onto the shaft at the lower, distal portion of the grip sleeve, in other embodiments, Securing Movement #2 may be performed before Securing Movement #1. Thus, in certain embodiments, the first and the second securing movements can be performed in no particular order.

In certain embodiments of the present invention, the interchangeable (e.g., removable, re-attachable, replaceable) golf club grip may also utilize, in addition to the grip sleeve that includes both a heel securing mechanism at an upper, proximal end and a contracting toe securing mechanism at a lower, distal end, a horn tool to assist in the application of the first and the second securing movements. In certain embodiments, the securing tool is in the form of a horn-shaped device to assist in the application of both the heel securing mechanism and the toe securing mechanism. For example, in certain embodiments, said device will aid in locating the grip sleeve onto the shaft, securing the upper, proximal portion of the grip sleeve in Securing Movement #1, and securing the lower, distal portion of the grip sleeve in Securing Movement #2.

In the third movement, called Rotational Movement #3, once both heel and toe embodiments of the grip have been fastened to the shaft, there is a need to decrease the internal core diameter of the grip sleeve in order to secure the grip to the shaft. Rotational Movement #3 can be one of several different movements using of internal diameter reducing structures, in which the internal core of the grip sleeve may be decreased by rotating or twisting the entire grip sleeve body, and in which an internal mechanism maintains the grip sleeve body in the torqued or twisted position, thereby preventing the grip sleeve body from rotating back. Thus, the grip includes a relaxed configuration and a torqued configuration, wherein the grip is maintained in the relaxed configuration throughout Securing Movements #1 and #2, and is maneuvered into the torqued configuration upon operation of Rotational Movement #3. In preferred embodiments, Rotational Movement #3 can be executed only once both Securing Movement #1 and Securing Movement #2 are complete.

In another embodiment, in a first movement, the grip is situated and secured into place on the shaft by fastening toe components at the lower, distal portion of the grip onto the shaft using an insertion tool. In the second movement, heel components of the grip are positioned onto the shaft, by either rotational torque or downward pressure, optionally using a tightening tool, which results in securing the upper, proximal portion of the grip onto the shaft. In the third movement, once both heel and toe embodiments of the grip have been fastened to the shaft, the internal core diameter of the grip is decreased in order to secure the grip to the shaft, such as by rotating or twisting the entire grip body, wherein an internal mechanism maintains the grip body in the torqued or twisted position, thereby preventing the grip body from rotating back.

There is thus provided, in accordance with an embodiment of the present invention, a method for attaching a grip onto a hollow golf club shaft at a handle region thereof, wherein the grip has an annular, longitudinal sleeve with an upper portion, a lower portion and a medial portion between the upper and lower portions, and the longitudinal sleeve has an internal diameter at its lower portion that is smaller than an external diameter of the shaft at a butt end thereof. In certain embodiments, the method comprises securing a first grip component at the lower portion of the grip onto the shaft using an insertion tool to force the lower portion of the longitudinal sleeve over the butt end of the shaft; securing a second grip component at the upper portion of the grip onto the shaft using a tightening tool; and tightening the grip medial portion onto the shaft by decreasing the internal diameter of the grip sleeve.

BRIEF DESCRIPTION OF THE DRAWINGS

The subject matter regarded as the invention is particularly pointed out and distinctly claimed in the concluding portion of this specification. The invention, however, both as to organization and method of operation, together with objects, features, and advantages thereof, may best be understood by reference to the following detailed descriptions when read with the accompanying drawings in which:

Figure 1:
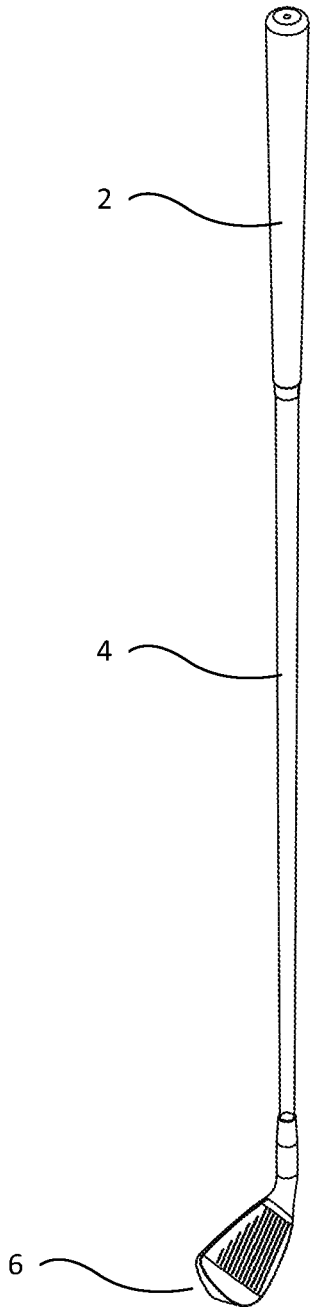
Fig. 1 Prior Art
FIG. 1 is an isometric view of a golf club in its main bodies according to the prior art.

It will be appreciated that, for simplicity and clarity of illustration, elements shown in the figures have not necessarily been drawn to scale. For example, the dimensions of some of the elements may be exaggerated relative to other elements for clarity. Additionally, the many features of any one embodiment shown in a figure should not be considered independent and separate from the features of an embodiment shown in another figure, and it is conceivable that features of any one embodiment may be combinable with another. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those of ordinary skill in the art that the present invention may be practiced without these specific details. In other instances, well-known methods, procedures, and/or components have not been described in detail so as not to obscure the present invention.

Reference is now made to FIG. 1, which is an isometric view of a golf club 3 in its main features according to the prior art. As shown in FIG. 1, a golf club 3, in its most basic form, may include a golf club head 6, a shaft or handle 4, and a grip 2. Shaft 4 has an elongated design with the handle 4 at a first, proximal end and the head 6 at a second, distal end. Shaft 4, for all permutations, may be made from a hard material such as, for example, aluminum, steel, titanium, plastic, a composite of these materials, or, in certain embodiments, any combination of these materials.

Figure 2A:
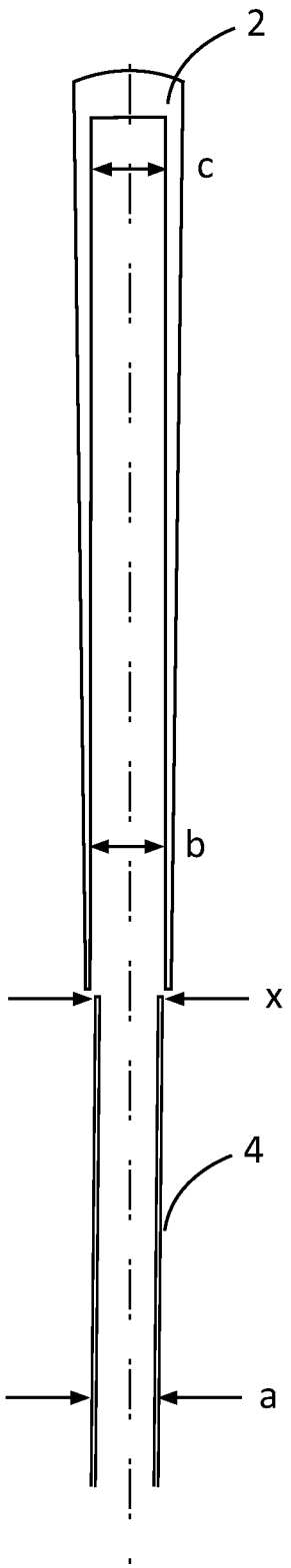
FIG. 2*a* is an illustration of dimensional perimeters before the rubber slides over the shaft.
Figure 2B:
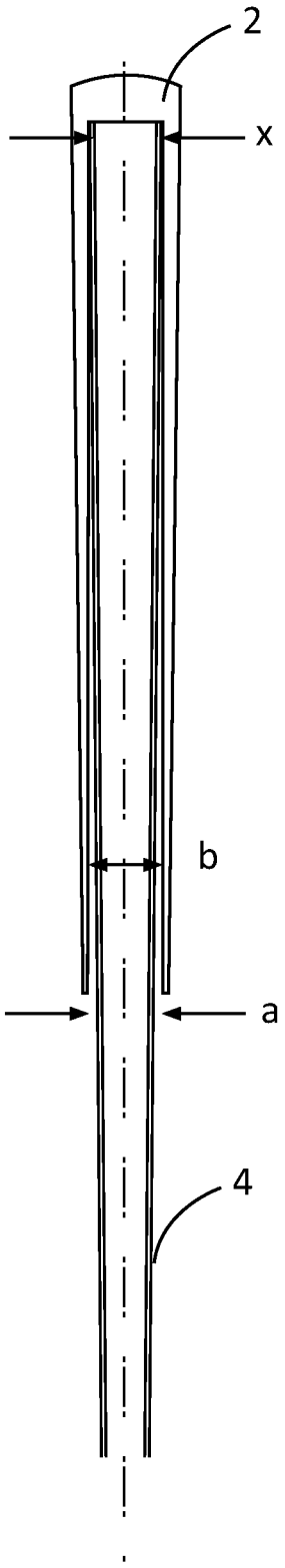
FIG. 2*b* is an illustration of dimensional perimeters after the rubber slides over the shaft, including the dimensional challenges required to secure the rubber to the shaft.

Reference is now made to both FIG. 2*a* and FIG. 2*b*, in which grip 2 and shaft 4 are shown, with shaft 4 having an upper diameter x and a lower diameter a, and with grip 2 having a lower internal diameter b and an upper internal diameter c. In order to attach grip 2 to shaft 4, grip 2 slides over a wider, outer diameter on an upper (e.g., proximal) portion of shaft 4, and is capable of fastening on the narrow, outer diameter on a lower (e.g., distal) portion of shaft 4, allowing grip 2 to be adaptable for all different varying diameters of shaft 4 that may arise. Thus, lower internal diameter b of grip 2 must be large enough to fit over upper diameter x of shaft 4. The process of attaching grip 2 to shaft 4 (e.g., according to embodiments of the present invention) is referenced in FIG. 3, by which showing the three movements required for attaching grip 2 onto shaft 4. The tapering and varying diameters of shaft 4 pose dimensional challenges and restricting perimeters as illustrated in FIG. 2*a* and FIG. 2*b*.

The present invention, as described herein, provides a novel grip 2 having a longitudinal or elongated, tubular grip sleeve including heel components 34 located at an upper, proximal portion (i.e., the heel) of the grip sleeve, and toe components 36 located at a lower, distal portion (i.e., the toe) of the grip sleeve. In preferred embodiments, heel components 34 and toe components 36, along with other components of the present invention, allow grip 2 to be installed and uninstalled on a shaft 4. In this way, grip 2 (e.g., grip sleeve) may be cylindrical or tubular, and may include an inner surface (e.g., a core 5). In certain embodiments, it is preferable that the grip sleeve has an internal diameter b or c that is larger than the outer diameter a or x of shaft 4 in order to allow grip 2 to slide over the largest possible diameter that could exist on shaft 4, which in certain embodiments is at the upper, proximal portion of shaft 4.

Figure 3:
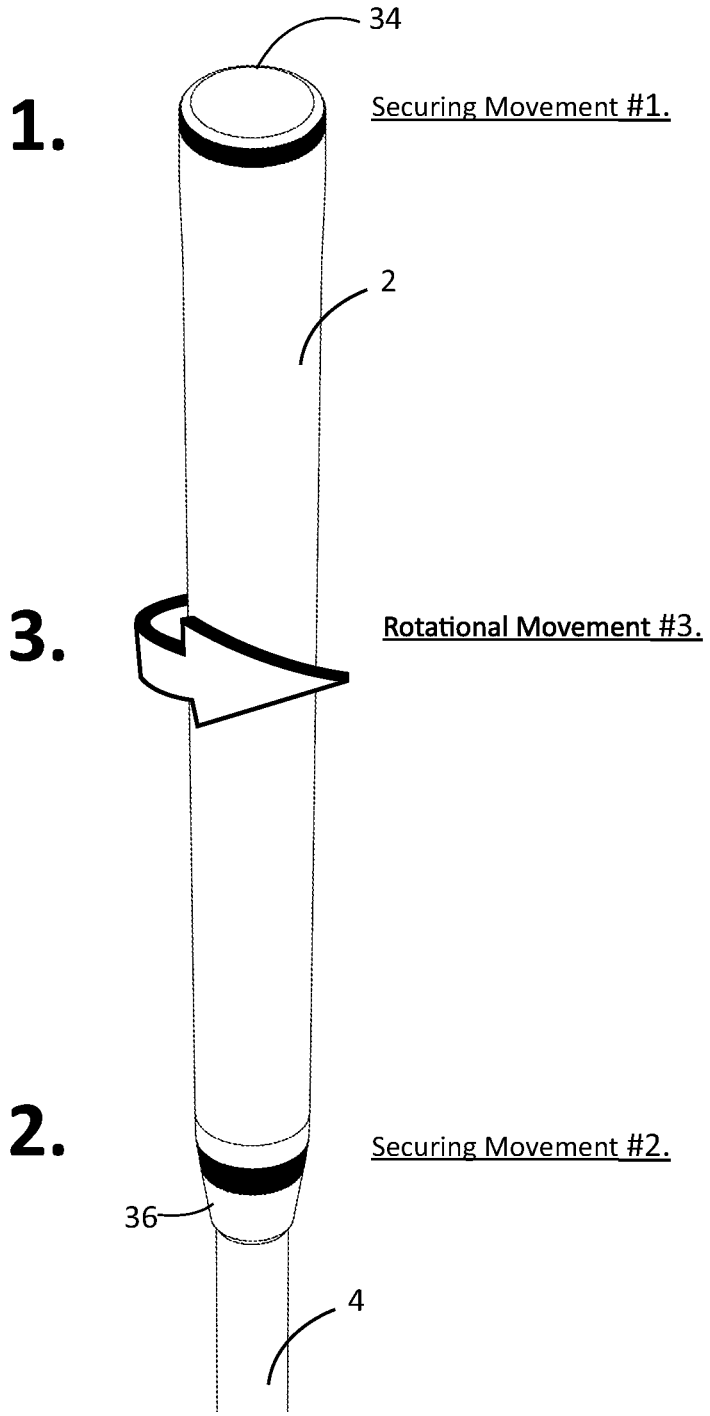
FIG. 3 is a perspective view of the grip and the three (3) movements that secure the grip to shaft according to aspects of certain embodiments of the present invention.
Figure 4:
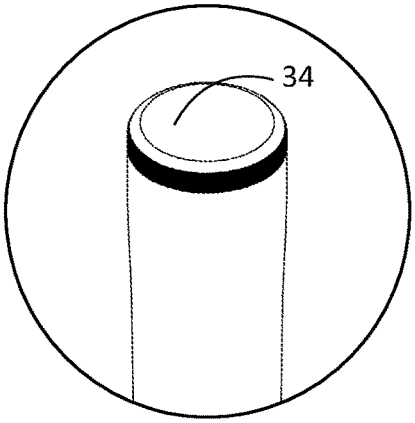
FIG. 4 is a perspective view of the heel components.

Reference is now made to FIG. 3, which is an isometric view of the novel grip 2 in its simplest form of the present invention, mounted (e.g., installed) on a shaft 4, with all visible, outer components of grip 2 according to aspects of certain embodiments of the present invention. As illustrated in FIG. 3, grip 2 requires three movements in order to completely secure grip 2 onto shaft 4. The first motion of the present invention is shown in FIG. 3 as Securing Movement #1, which is a movement that secures the heel components 34 located at an upper, proximal portion of the grip sleeve to the upper portion of shaft 4. The second motion of the present invention is shown in FIG. 3 as Securing Movement #2, which is a movement that secures the toe components 36 located at a lower, distal portion of the grip sleeve to shaft 4. The third motion of the present invention is shown in FIG. 3 as Rotational Movement #3, which is a movement that secures the region of grip 2 between the heel components 34 and the toe components 36 to shaft 4 to allow grip 2 to be installed on a shaft 4. An upper, proximal portion of grip 2 can be referred to as heel components 34, which provides all aspects of securing movement required for said upper, proximal portion. Reference is now made to FIG. 4, which is an isometric view of the upper, proximal portion of grip 2, and makes specific reference to the variety of embodiments and securing methods for fastening heel components 34 to shaft 4. The securing methods are referred to as Heel Securing Methods A, B and C. These Heel Securing Methods are all forms of Securing Movement #1, which involve fixing heel components 34 to the shaft 4, as shown in FIGS. 4*a*, 4*b* and 4*c*, respectively.

As illustrated in FIG. 4, in some embodiments, an upper, proximal portion of grip 2 may have different forms of heel components 34 that are each configured for differently fastening said part to the shaft 4. These heel securing methods all act as a single function of securing the upper, proximal portion of grip 2 to shaft 4. These operate to aid attaching and detaching grip 2 from shaft 4 in installed and uninstalled configurations, respectively. The Heel Securing Methods are illustrated in isometric views FIGS. 4*a*, 4*b* and 4*c*, which are described individually herein Heel Securing Method A can be understood from FIG. 4*a*, which is an isometric view of the internal, non-visible components according to aspects of certain embodiments of the present invention that are used for heel securing method A. As illustrated in FIG. 4*a*, in some embodiments, the upper, proximal portion of heel 34 may include, for example, a back cap 8, lead screw 12, a ratchet gear 16, a ratchet gear hub 18, an expandable tube 20, and a compression nut 22.

As referred to elsewhere herein, grip cap 8, lead screw 12, ratchet gear 16, ratchet gear hub 18, expandable tube 20, and compression nut 22, make up the heel components 34 for Heel Securing Method A, each of which is located at the upper, proximal portion of grip 2.

Figure 4A:
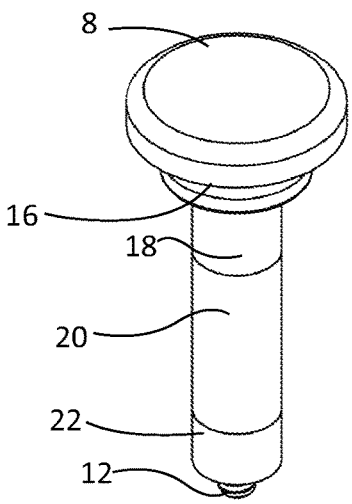
FIG. 4*a* is a perspective view of Heel Securing Method A and all components according to aspects of certain embodiments of the present invention.
Figure 4B:
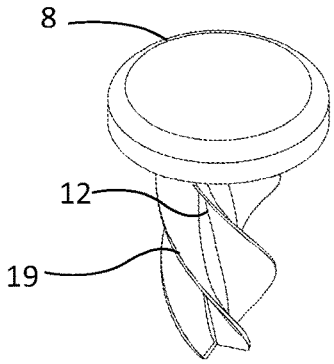
FIG. 4*b* is a perspective view of Heel Securing Method B and all components according to aspects of certain embodiments of the present invention.
Figure 4C:
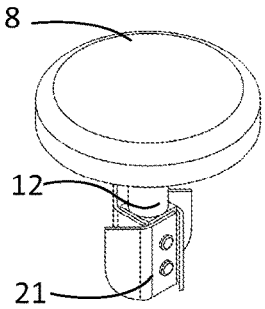
FIG. 4*c* is a perspective view of Heel Securing Method C and all components according to aspects of certain embodiments of the present invention.
Figure 5:
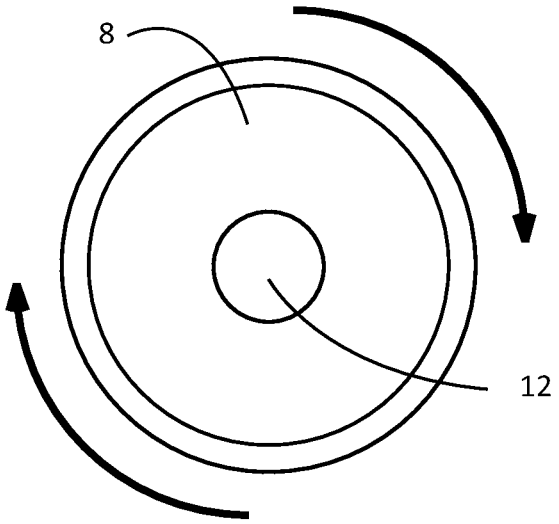
FIG. 5 is a top sectional view of Heel Securing Method A, showing the movements required to secure embodiment to the shaft.

Reference in now made to FIGS. 4*a* and 5, which show heel components 34 specifically relating to Heel Securing Method A, showing a lead screw 12 connected to grip cap 8 according to aspects of certain embodiments of the present invention. As illustrated in FIGS. 4*a*, 5, 5*a* and 5*b*, the upper, proximal portion of grip 2 houses heel components 34 specifically relating to Heel Securing Method A.

Figure 5A:
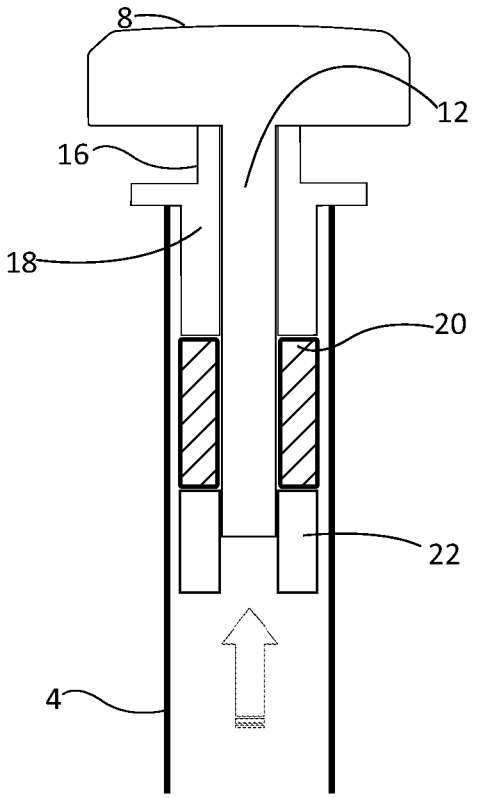
FIG. 5*a* is a side cross-sectional view of Heel Securing Method A before it is secured inside of the shaft.
Figure 5B:
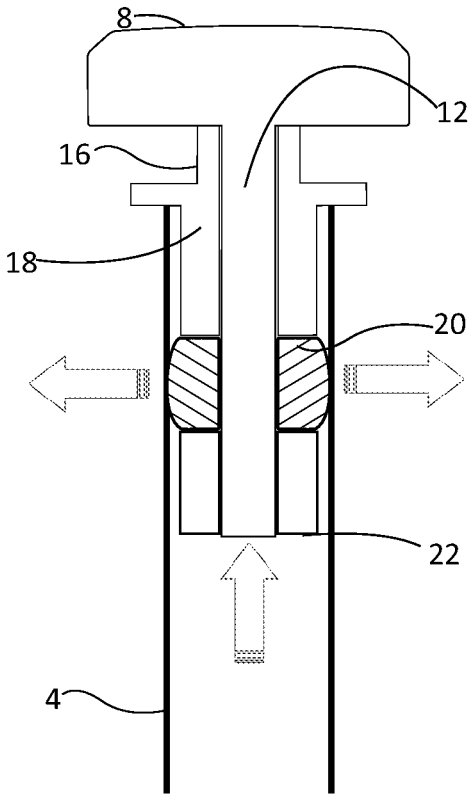
FIG. 5*b* is a side cross-sectional view of Heel Securing Method A after it is secured inside of the shaft, illustrating said functions.

In certain embodiments, as shown in FIGS. 5*a* and 5*b*, compression nut 22 is threaded onto lead screw 12, which is located at a distal end of (e.g., below) expandable tube 20. In preferred embodiments, compression nut 22 may include internal threads configured to engage with external threads on lead screw 12. In certain embodiments, ratchet gear hub 18 is located at a proximal end of (e.g., on top of) expandable tube 20. In this way, expandable tube 20 is located in between compression nut housing 22 and ratchet gear hub 18.

In preferred embodiments, each of compression nut 22, expandable tube 20, ratchet gear hub 18, ratchet gear 16 and ratchet paw housing includes an internal bore configured to accept lead screw 12 as illustrated in, for example, relaxed and torqued positions shown in FIGS. 5*a* and 5*b*. In preferred embodiments, the internal bores of each component are arranged co-axially with each other to allow insertion of lead screw 12. Expandable tube 20 is not confined to one generic movement to fix heel components 34 to shaft 4, but may also include expandable metal collets, tapered "v" designs, or any other internal expanding and contracting apparatuses that may expand upon twisting or pushing.

Heel Securing Method B can be understood from FIG. 4*b*, which is an isometric view of the internal, non-visible components according to aspects of certain embodiments of the present invention that are used for heel securing method B. As illustrated in FIG. 4*b*, in some embodiments, the upper, proximal portion of heel 34 may include, for example, a back cap 8, lead screw 12, and a tapered helix insert 19.

As referred to elsewhere herein, grip cap 8, lead screw 12, and a tapered helix insert 19, make up the heel components 34 for Heel Securing Method B, each of which is located at the upper, proximal portion of grip 2.

Figure 6:
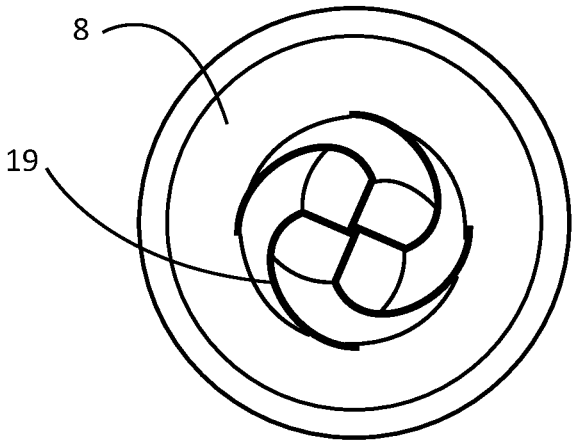
FIG. 6 is a top sectional view of Heel Securing Method B, showing the movements required to secure embodiment to the shaft.
Figure 6A:
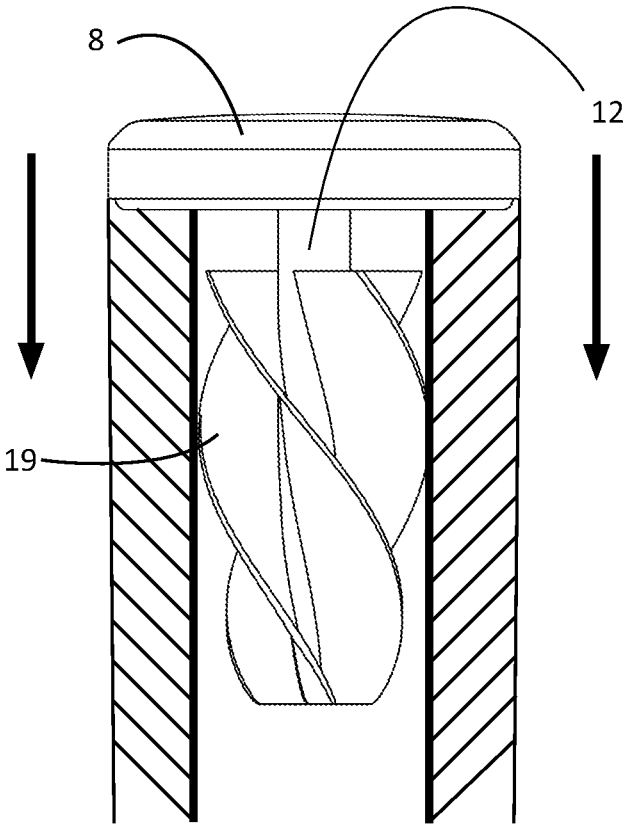
FIG. 6*a* is a side cross-sectional view of Heel Securing Method B secured inside of the shaft from downward pressure according to aspects of certain embodiments of the present invention.

Reference in now made to FIGS. 4*b* and 6, which show heel components 34 specifically relating to Heel Securing Method B, showing a lead screw 12 connected to grip cap 8 according to aspects of certain embodiments of the present invention. As illustrated in FIGS. 4*b*, 6 and 6*a*, the upper, proximal portion of grip 2 houses heel components 34 specifically relating to Heel Securing Method B.

In certain embodiments, tapered helix insert 19 is located around lead screw 12, which is located at a distal end of (e.g., below) grip cap 8. In preferred embodiments, tapered helix insert 19 is pressed into the upper, proximal portion of shaft where it is located (e.g., co-axially) within the terminal, proximal end of the sleeve of grip 2. In certain embodiments, tapered helix insert 19 may be embedded within, or otherwise connected to, the grip sleeve 2 as shown in FIG. 6*a*, and may rotate in one direction only. In this embodiment, grip cap 8 is pressed into shaft 4 to secure tapered helix insert 19 in place.

Heel Securing Method C can be understood from FIG. 4*c*, which is an isometric view of the internal, non-visible components according to aspects of certain embodiments of the present invention that are used for heel securing method C. As illustrated in FIG. 4*c*, in some embodiments, the upper, proximal portion of heel 34 may include, for example, a back cap 8, lead screw 12, and a flanged compression spring nut 21.

As referred to elsewhere herein, grip cap 8, lead screw 12, and multi star flanged compression spring nut 21, make up the heel components 34 for Heel Securing Method C, each of which is located at the upper, proximal portion of grip 2.

Figure 7:
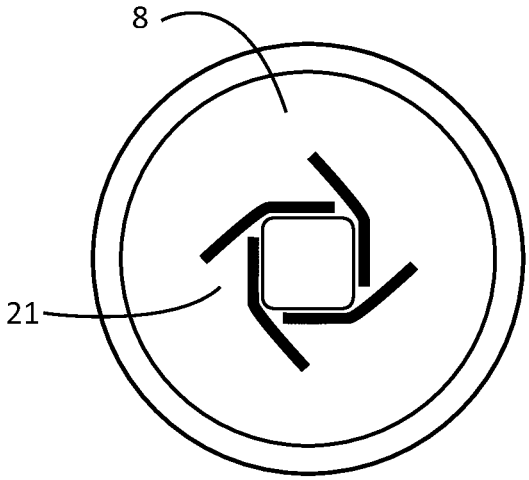
FIG. 7 is a top sectional view of Heel Securing Method C, showing the movements required to secure embodiment to the shaft.
Figure 7A:
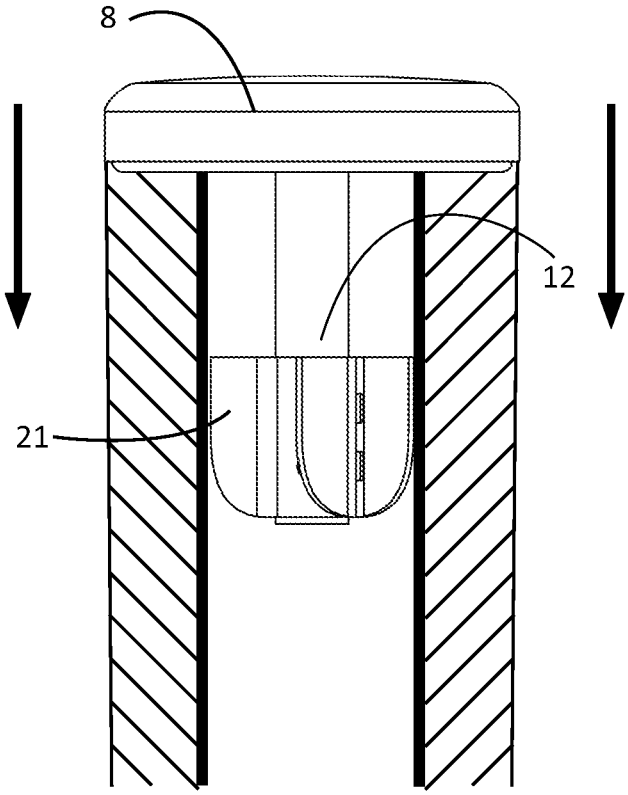
FIG. 7*a* is a side cross-sectional view of Heel Securing Method C secured inside of the shaft from downward pressure according to aspects of certain embodiments of the present invention.

Reference in now made to FIGS. 4*c* and 7, which show heel components 34 specifically relating to Heel Securing Method C, showing a lead screw 12 connected to grip cap 8 according to aspects of certain embodiments of the present invention. As illustrated in FIGS. 4*c*, 7 and 7*a*, the upper, proximal portion of grip 2 houses heel components 34 specifically relating to Heel Securing Method C.

In certain embodiments, Multi Star Spring Nut 21 is a flanged compression nut located around lead screw 12, which is located at a distal end of (e.g., below) grip cap 8. In preferred embodiments, Multi Star Spring Nut 21, which is shown to have four (4) legs or flanges, although the number of legs is not limited to 4, is pressed into the upper, proximal portion of shaft where it is located (e.g., co-axially) within the terminal, proximal end of the sleeve of grip 2. In certain embodiments, Multi Star Spring Nut 21 may be embedded within, or otherwise connected to, the grip sleeve 2 as shown in FIG. 7*a*, and may rotate in one direction only. In this embodiment, grip cap 8 is pressed into shaft 4 to secure tapered Multi Star Spring Nut 21 in place.

FIGS. 5*a*, 6*a*, and 7*a* are all cross-sectional views of the heel components 34 of all heel securing methods, according to aspects of certain embodiments of the present invention. As shown in said figures, shaft 4 extends between the grip sleeve's inner surface (e.g., core 5) and heel components 34. In some embodiments, ratchet gear hub 18 may include at least two protruding arms or, in other embodiments, an annular ring which operates as a stop preventing shaft 4 from extending out of the proximal end of grip 2 and also ensuring proper positioning of shaft 4 for installing and securing grip 2 (see, e.g., FIGS. 5*a*, 6*a*, and 7*a*). In an installed position, lead screw 12 extends through heel components 34 until it engages with compression. In preferred embodiments, grip cap 8, to which lead screw 12 is connected, rests on top of the grip sleeve and provides a surface grip that a user may grip and twist (e.g., rotate) lead screw 12.

Figures 25A, 25B, 25C, 25D, 25E:
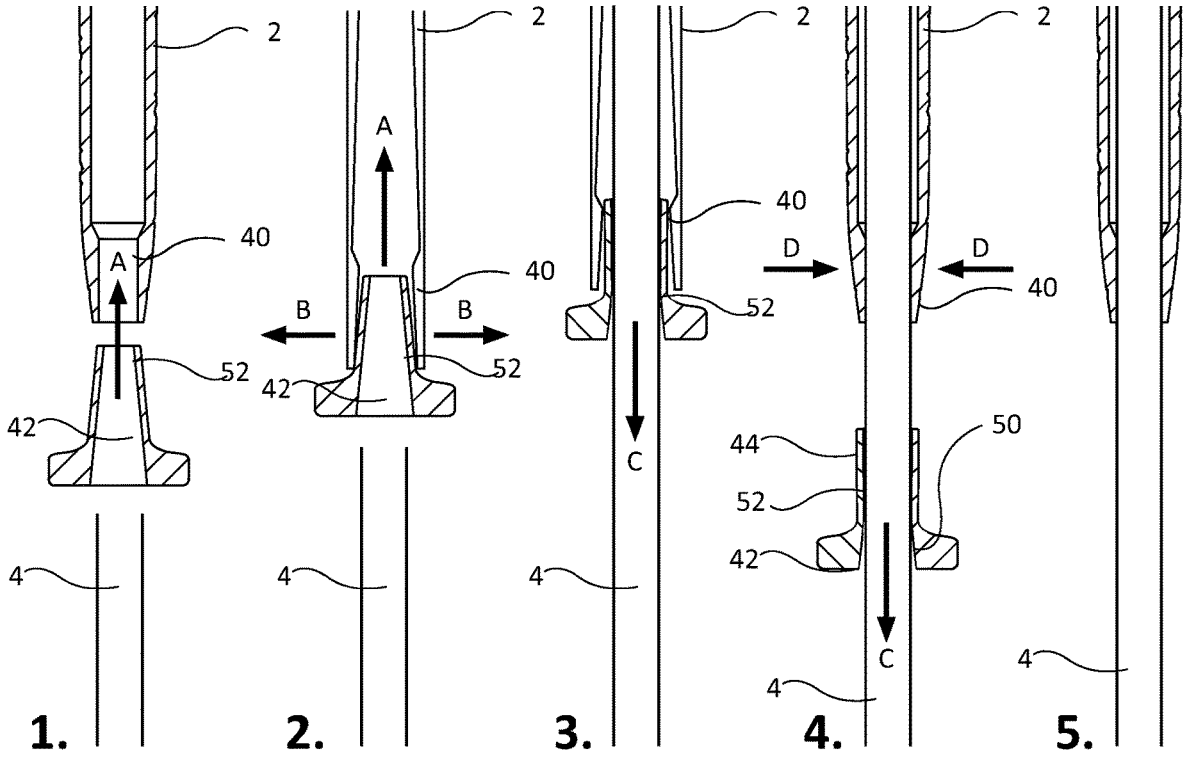
FIGS. 25*a-e* are cross sectional side views showing successive positions of the Toe Securing Method C components when the lower, distal portion of grip sleeve is being secured onto the upper, proximal portion of the shaft using the securing tool, according to aspects of certain embodiments of the present invention.

Reference is now made to FIGS. 25*a* and 25*b*, which are top and bottom perspective views, respectively, of an external device, Securing Tool 42, that may assist in the application of the Securing Movements #1 and #2. Most relevant here is that securing tool 42 may be used to apply a greater torque to the movements to grip cap 8 than are possible with the user's hand when operating any of Heel Securing Methods A, B and C. Horn Securing Tool 42 having a splined bottom profile 48 that locates and engages into grip cap 8 corresponding profile.

Figure 24A:
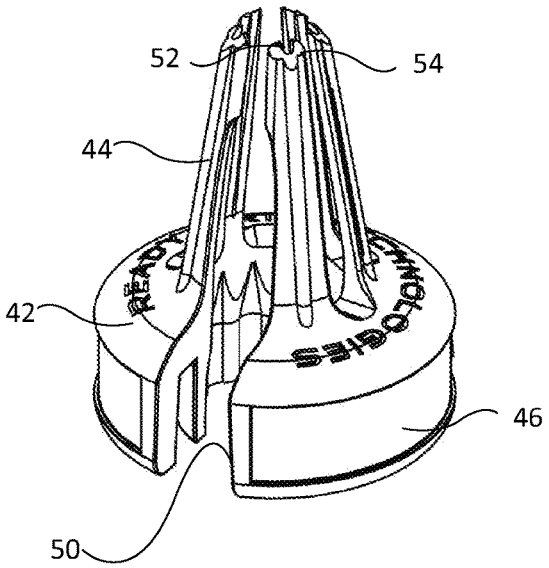
FIGS. 24*a* and 24*b* are a top perspective view and a bottom perspective view, respectively, of the securing tool, according to aspects of certain embodiments of the present invention.
Figure 24B:
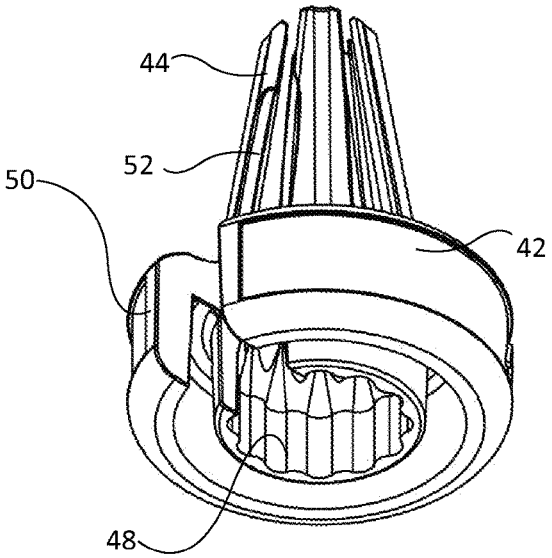

As shown in FIGS. 24*a* and 24*b*, securing tool 42 has two functional ends. An upper functional end of securing tool 42, shown best in FIG. 24*a*, includes a plurality of flexible prongs 44 that extend outward from the base 46 of securing tool 42 and are angled inward from the base 46 to their distal ends. Each of prongs 44 has a tapered end 54 and an internal protruding splines 52 that aids in Securing Movements #2, as will be discussed hereinbelow.

A lower functional end of securing tool 42, shown best in FIG. 24*b*, has a circular protruding rim 47 inside the base 46 that includes a plurality of spline teeth 48. Spline teeth 48 preferably have a geometric profile that allows them to key/locate into grip cap 8, aiding the motions in Securing Movements #1. Securing tool 42 also includes a gap or a split opening 50 in it that allows the entire securing tool 42 to be opened completely, so as to allow securing 42 to be inserted onto a shaft 2, as will also be discussed hereinbelow.

Figure 27:
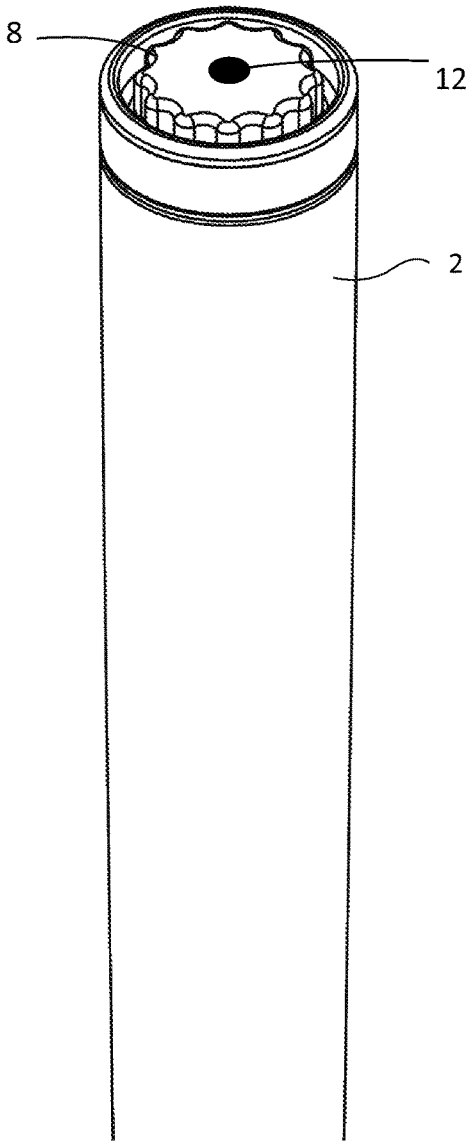
FIG. 27 is a close-up perspective view of the upper, distal portion of the grip and shaft prior to Heel Securing Method D, according to aspects of certain embodiments of the present invention.

As discussed previously, and as illustrated, for example, in relaxed and torqued positions shown in FIGS. 5*a* and 5*b*, each of compression nut 22, expandable tube 20, ratchet gear hub 18, ratchet gear 16 and ratchet paw housing 14 includes an internal bore configured to accept lead screw 12. In preferred embodiments, the additional use of securing tool 42 aids in optional greater torqued motions, and this is accomplished by engaging the spline teeth 48, shown in FIG. 24*b*, into the matching profile of grip cap 8, shown in FIG. 27.

Figure 28:
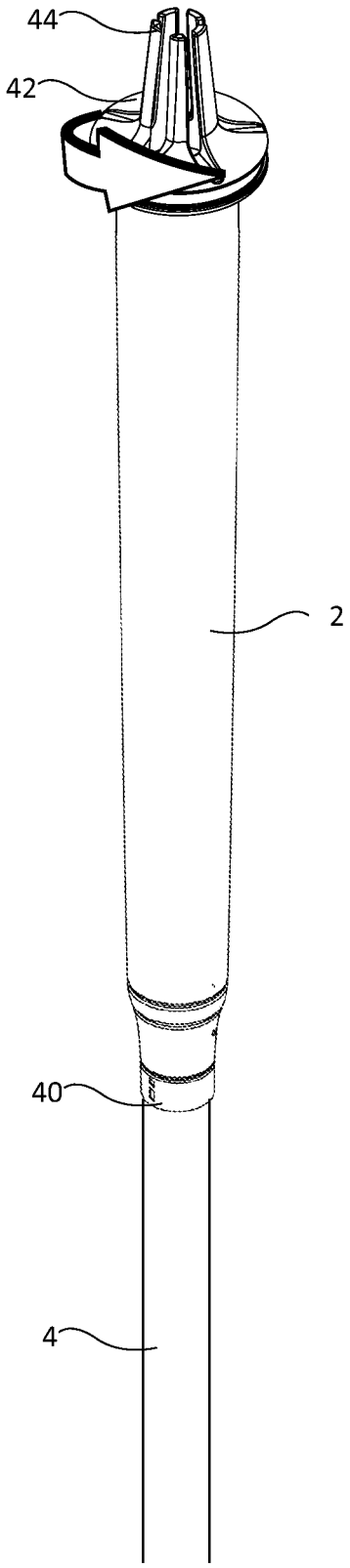
FIG. 28 is a perspective view of the securing tool attached to the upper, distal portion of the grip during the Heel Securing Method D, according to the aspects of the certain embodiments of the present invention.
Figure 30:
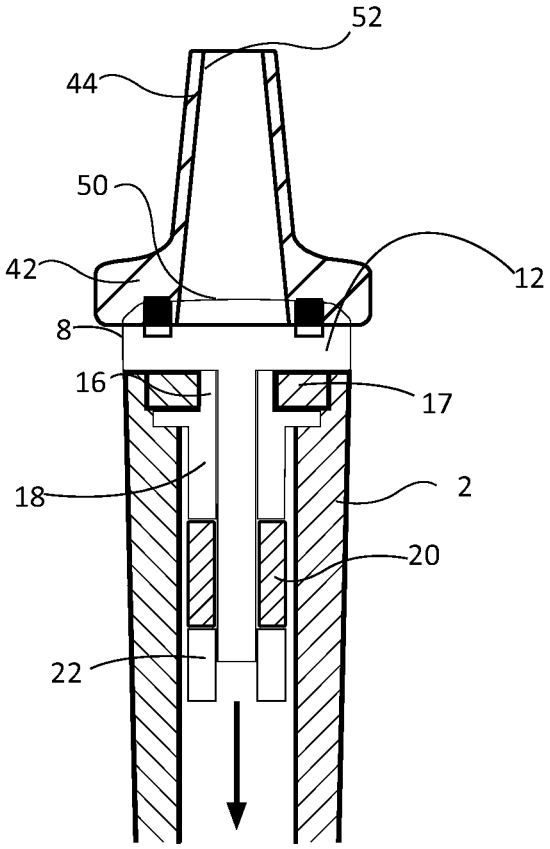
FIG. 30 is a side cross-sectional view of Heel Securing Method D before the upper, distal portion of the grip is secured to the shaft, showing the securing tool and its relation to the grip sleeve toe, according to aspects of certain embodiments of the present invention.
Figure 32:
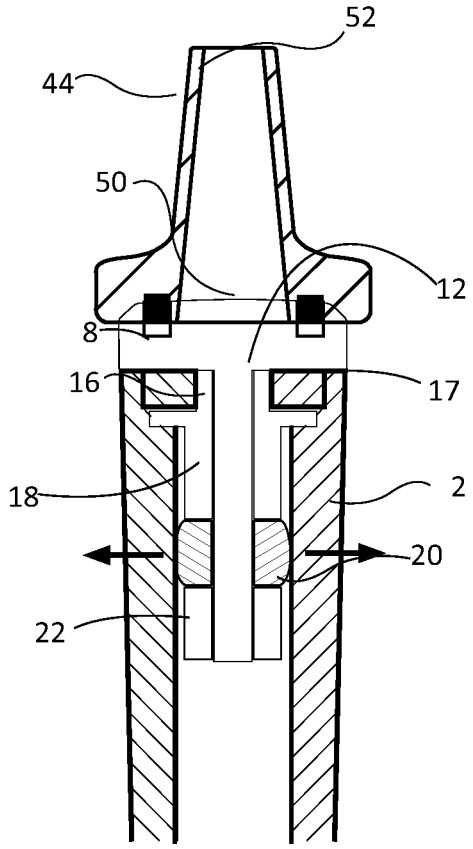
FIG. 32 is a side cross-sectional view of Heel Securing Method D after the upper, distal portion of the grip is secured to the shaft, showing the securing tool and its relation to the grip sleeve, according to aspects of certain embodiments of the present invention.
Figure 33A:
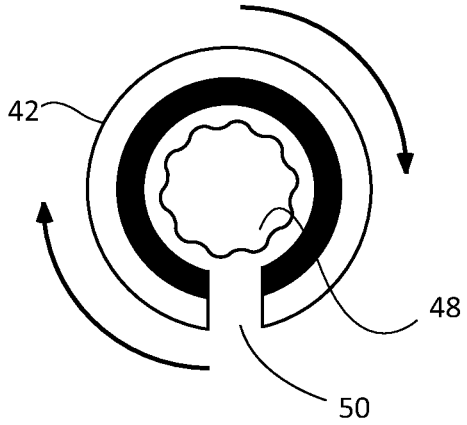
FIGS. 33*a-e* are bottom sectional views of the securing tool with alternative internal splined bottom keys that locate accordingly into the upper proximal portion of the gripping sleeve, according to the aspects of certain embodiments of the present invention.
Figure 33B:
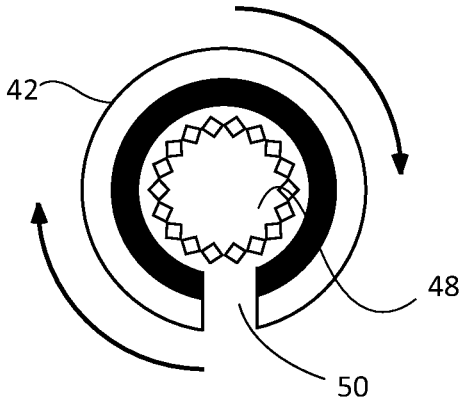
Figure 33C:
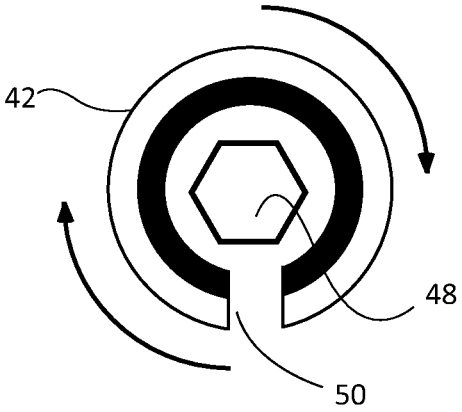
Figure 33D:
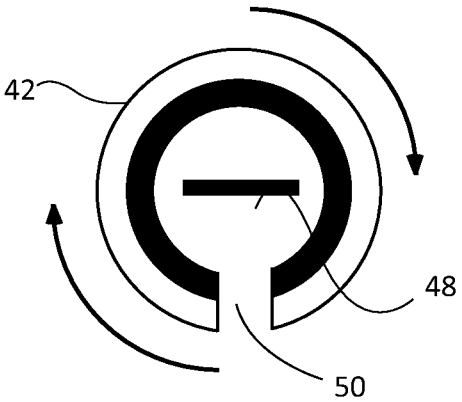
Figure 33E:
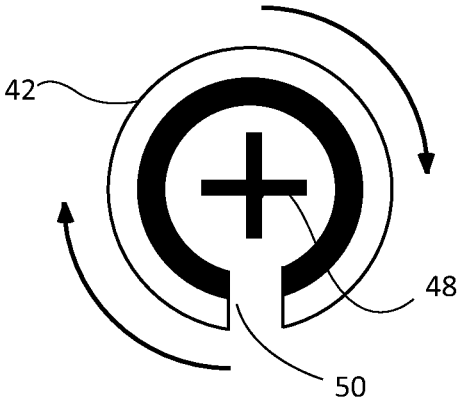

While spline teeth 48 may consist of any locating profile shapes, it is preferred that spline teeth 48 correspond with the indentation profile in grip cap 8. As illustrated in side view in FIG. 30, the lower functional end of securing tool 42 is inserted into grip cap 8, such that spline teeth 48 engage with the indentation profile in grip cap 8. A user then grips base 46, via its outer gripping edge on the lower distal portion thereof, and rotates securing tool 42 within grip 2 relative to shaft 4, as shown in FIG. 28. As illustrated in side view in FIG. 32, lead screw 12 engages with compression nut 22 and draws it into expandable tube 20, and causes expandable tube 20 to expand within shaft 4, so as to secures heel components 34 onto shaft 4.

Figure 29:
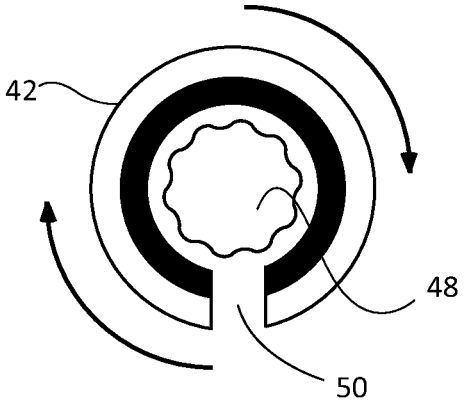
FIG. 29 is a bottom sectional view of Heel Securing Method D, showing the movements required to secure the upper, distal portion of the grip to the shaft, with the addition of the use of the securing tool and its relation to the grip sleeve, according to aspects of certain embodiments of the present invention.

In certain embodiments of FIG. 29, splined teeth 48 are not limited to any one particular profile, as a wide range of shapes could key into any corresponding profile between grip cap 8 and splined teeth 48, as illustrated in FIGS. 33*a-e*.

Figure 8:
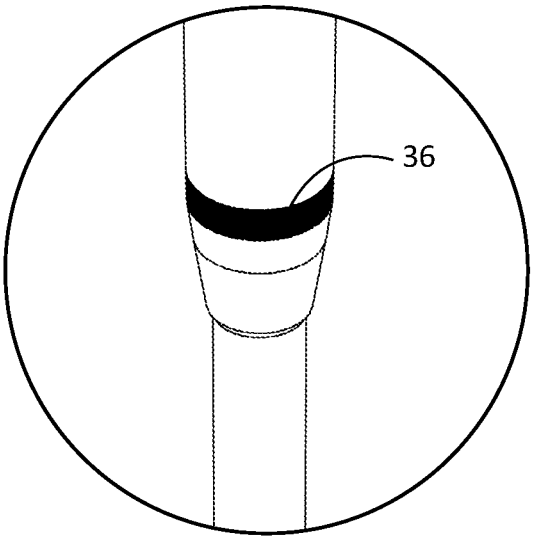
FIG. 8 is a perspective view of the toe components.

The components of each of Heel Securing Methods A, B and C are used for the single function of securing the upper, proximal portion of grip 2 together with, inter alia, lower, distal portion of grip 2, which can be referred to as toe components 36, referenced in FIG. 8 in its purest form. These operate to aid attaching and detaching grip 2 from shaft 4 in installed and uninstalled configurations, respectively. As discussed above, any of Heel Securing Methods A, B and C could incorporate the use of securing tool 42.

Figure 8A:
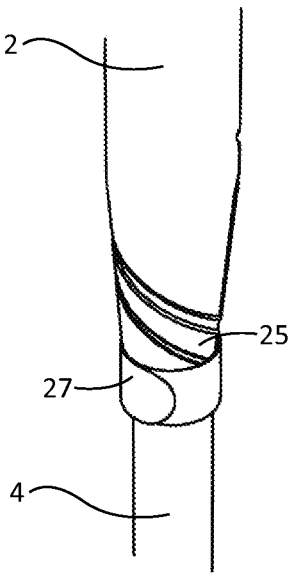
FIG. 8*a* is a perspective view of Toe Securing Method A and all components according to aspects of certain embodiments of the present invention.
Figure 8B:
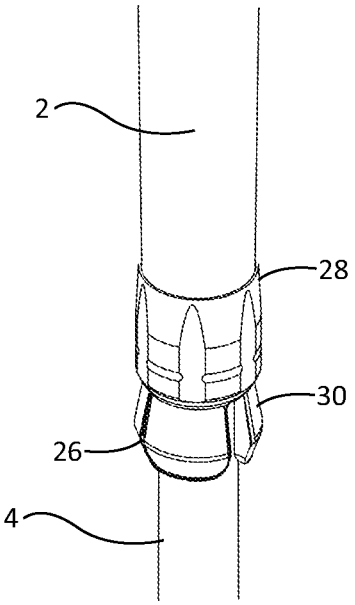
FIG. 8*b* is a perspective view of Toe Securing Method B and all components according to aspects of certain embodiments of the present invention.

Toe components 36 are similar to heel components 34 in that they make up the lower, distal portion of grip 2. Reference is now made to FIG. 8, which is an isometric view of the lower, distal portion of grip 2, and makes specific reference to the variety of securing methods for fastening toe components 36 to shaft 4. The securing methods are referred to as Toe Securing Methods A, B and C. These Toe Securing Methods are all forms of Securing Movement #2, which involve fixing toe components 36 to the shaft 4, as shown in FIGS. 8*a*, 8*b* and 25.

As illustrated in FIG. 8, in some embodiments, a lower, distal portion of grip 2 may have different forms of toe components 36 that are each configured for differently fastening said part to the shaft 4. The toe securing methods all act as a single function of securing the lower, distal portion of grip 2 to shaft 4. These operate to aid attaching and detaching grip 2 from shaft 4 in installed and uninstalled configurations, respectively. The Toe Securing Methods are illustrated in isometric views FIGS. 8*a*,8*b* and 25, which are described individually herein.

Figure 9A:
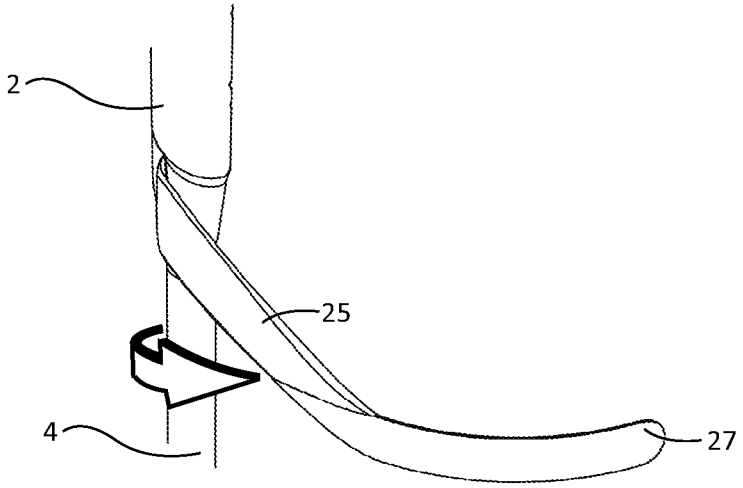
FIG. 9*a* is a perspective view of lower grip portion Toe Securing Method A in its relaxed securing position before the embodiment is secured to the shaft.
Figure 9B:
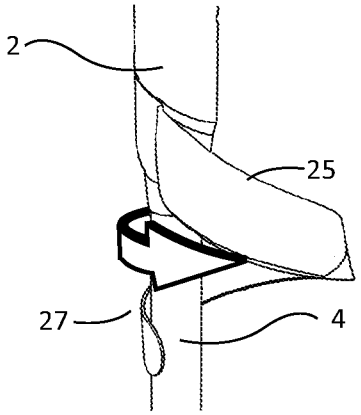
FIG. 9*b* similar to FIG. 9*a* is a perspective view of lower grip portion Toe Securing Method A in its movements as it torques around the circumference of the shaft.
Figure 9C:
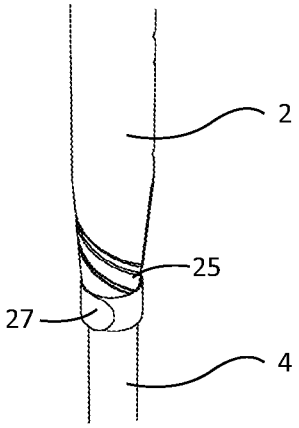
FIG. 9*c* is a perspective view of lower grip portion Toe Securing Method A and all components according to aspects of certain embodiments of the present invention fully secured to the shaft.

Toe Securing Method A can be understood from FIGS. 9*a*, 9*b*, and 9*c*, which are isometric views of the internal, non-visible components according to aspects of certain embodiments of the present invention that are used for toe securing method A. As illustrated in FIGS. 8*a*, 9*a*, 9*b*, and 9*c*, in some embodiments, the lower, distal portion of grip 2 may include, for example, an elongated flexible strap 25, securing surface patch 27, and a "v" split 29.

As referred to elsewhere herein, an elongated flexible strap 25, securing surface patch 27, and a "v" split 29, make up the toe components 36 for Toe Securing Method A, each of which is located at the lower, distal portion of grip 2.

Reference is now made to FIGS. 9*a*, 9*b*, and 9*c*, which are three isometric views of the lower, distal portion of the grip sleeve of grip 2 and the movements by which toe components 36 are secured to shaft 4, showing toe components 36 specifically relating to Toe Securing Method A according to aspects of certain embodiments of the present invention. As shown in FIGS. 9*a*, 9*b*, and 9*c*, the distal portion of the grip sleeve 2 may include, in certain embodiments, an elongated flexible strap 25, securing surface patch 27, and a "v" split 29, make up the toe components 36 for Toe Securing Method A, each of which is located at the lower, distal portion of grip 2.

Figure 10A:
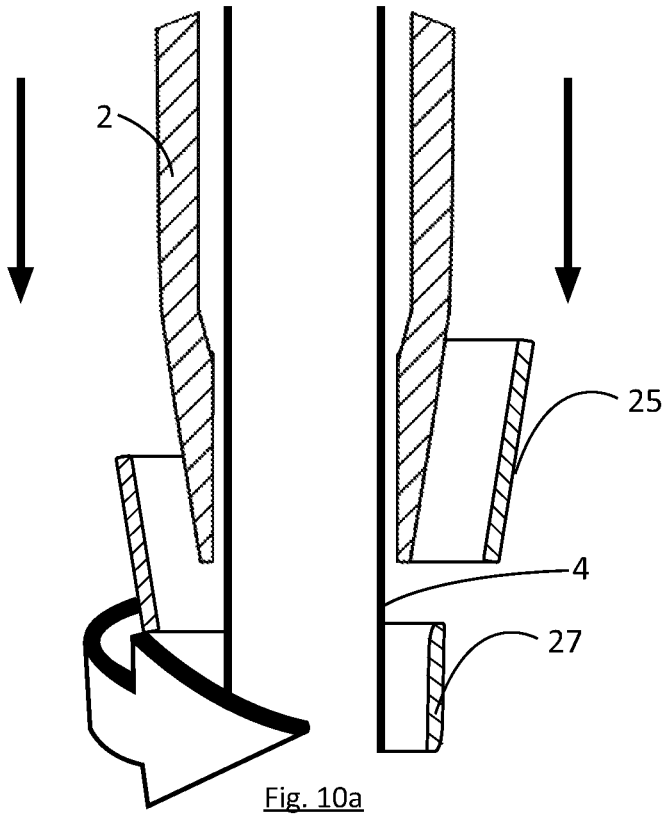
FIG. 10*a* is a side cross-sectional view of Toe Securing Method A components in a relaxed position according to aspects of certain embodiments of the present invention.
Figure 10B:
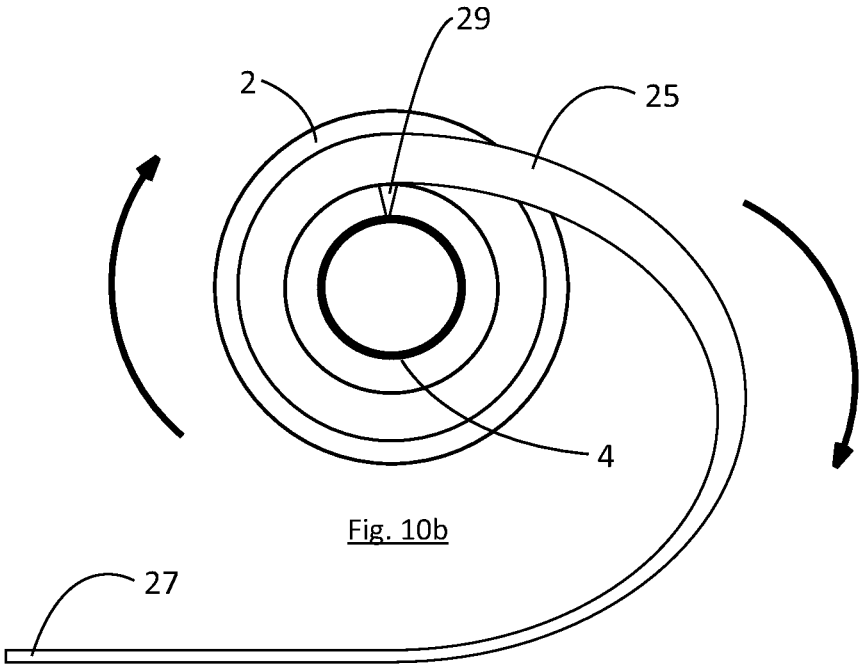
FIG. 10*b* is a top cross-sectional view of Toe Securing Method A components in a relaxed position according to aspects of certain embodiments of the present invention.

In preferred embodiments, flexible strap 25 is an elongated extension of rubber grip sleeve 2, having a securing surface 27 imbedded into said flexible strap 25. The securing surface may be any self-locking surface texture and not limited to one practical method (e.g.; Velcro, double sided tape, snap fit buttons, and/or other fastener materials). As shown in FIGS. 10*a* and 10*b*, which are side and top cross-sectional views of the preferred embodiments, flexible strap 25, and securing surface 27 preform as a "torsional wrap". This movement allows flexible strap 25 to compress around the shaft 4, as it is wrapped around said body. Securing surface 27 acts as a termination point for flexible strap 25, to be secured onto itself locking toe components 36 specifically relating to Toe Securing Method A against shaft 4.

Figure 11A:
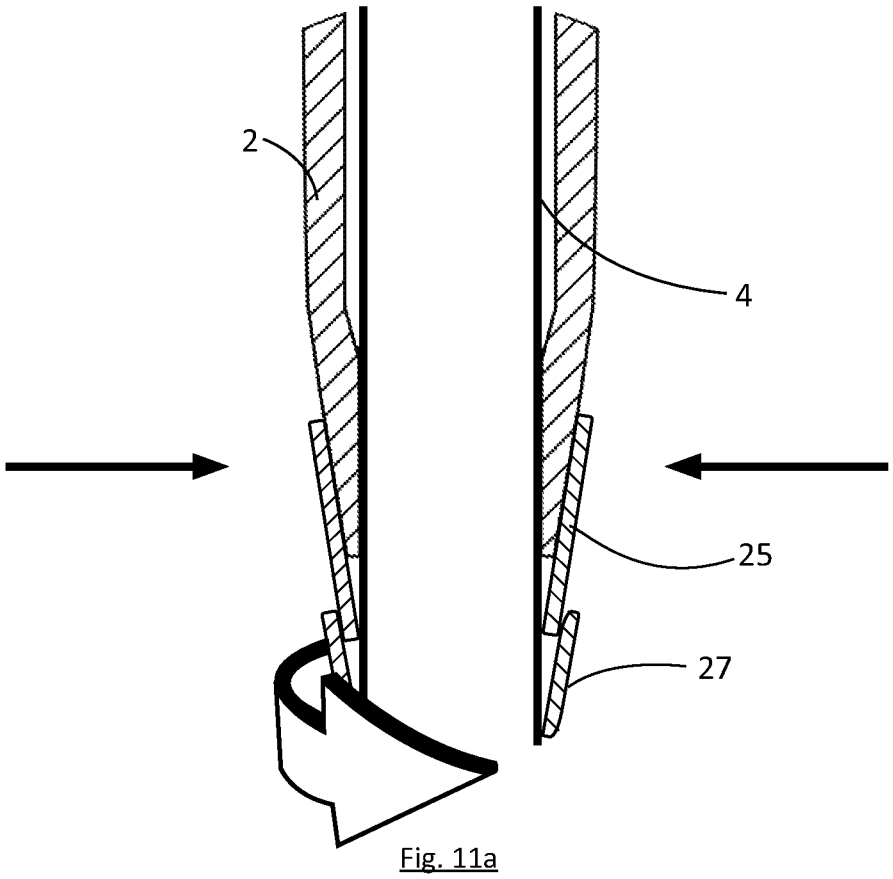
FIG. 11*a* is a side cross-sectional view of Toe Securing Method A components illustrated in FIG. 10*a* secured to the shaft in a torqued position according to aspects of certain embodiments of the present invention.
Figure 11B:
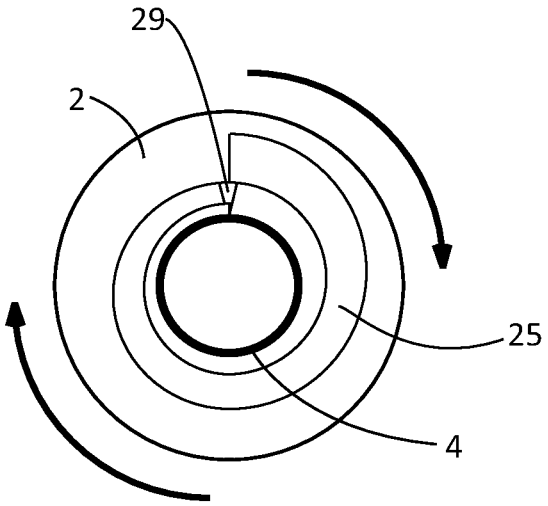
FIG. 11*b* is a top cross-sectional view of Toe Securing Method A components illustrated in FIG. 10*b* secured to the shaft in a torqued position according to aspects of certain embodiments of the present invention.

FIGS. 10*a* and 10*b* show flexible strap 25 in a relaxed position. FIGS. 11*a* and 11*b* are side and top cross-sectional views of toe components 36 specifically relating to Toe Securing Method A when in the torqued secured position, according to aspects of certain embodiments of the present invention.

Now reference is being made to "v" split 29, which allows lower, distal portion of grip 2, to have a smaller diameter and expand over the maximum diameters occurring in shaft 4, (e.g., FIGS. 2*a* and 2*b*). Furthermore, it will have less material to compress when securing to the shaft 4, once grip 2 assumes its desired position on shaft 4.

Figure 12A:
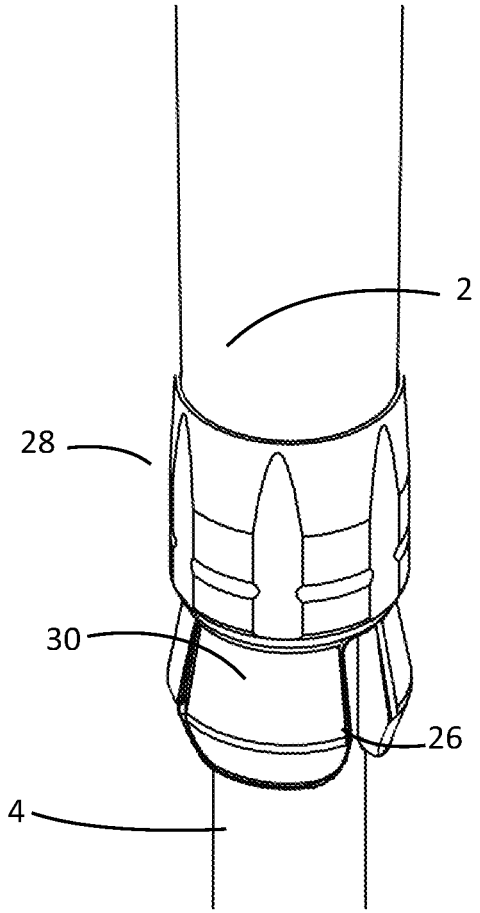
FIG. 12*a* is an isometric view of a lower grip portion Toe Securing Method B with all visible, outer components according to aspects of certain embodiments of the present invention.
Figure 12B:
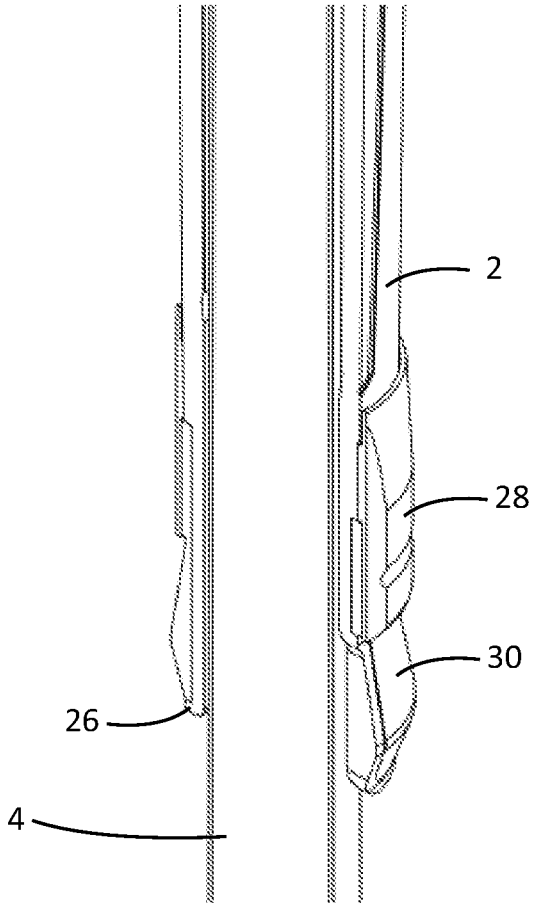
FIG. 12*b* is an isometric cross-sectional view of the lower grip portion Toe Securing Method B illustrated in FIG. 12*a* with internal, non-visible components according to aspects of certain embodiments of the present invention.

Toe Securing Method B can be understood from FIGS. 12*a* and 12*b*, which are isometric views of the internal, non-visible components according to aspects of certain embodiments of the present invention that are used for toe securing method B. As illustrated in FIGS. 8*b*, 12*a* and 12*b*, a flange housing 26, a threaded flange lock sleeve 28, and a flange collet 30 are shown. In certain embodiments, flange collet 30 may include three (3), four (4) or more (e.g., a plurality) of flanges.

As referred to elsewhere herein, flange housing 26, threaded flange lock sleeve 28, and flange collet 30 make up toe components 36, each of which is located at the lower, distal portion of grip 2.

FIGS. 12*a* and 12*b* are an isometric external and cross-sectional views, respectively, of the lower, distal portion of the grip sleeve of grip 2 showing the movements by which showing toe components 36 specifically relating to Toe Securing Method B are secured to shaft 4, according to aspects of certain embodiments of the present invention. As shown in FIG. 8*b*, the distal portion of the grip sleeve may include, in certain embodiments, a flange housing 26, a threaded flange lock sleeve 28, and a threaded flange collet 30. In certain embodiments, flange housing 26 forms part of the sleeve of grip 2, and is configured to house flange collet 30 (see, e.g., FIGS. 12*b* and 13*a*). For example, in certain embodiments, flange collet 30 is embedded within flange housing 26.

In preferred embodiments, flange collet 30 may include at least two, but preferably three or more flanges. In some embodiments, each flange of flange collet 30 may include a proximal taper portion, a shoulder, and a distal taper portion as illustrated in, for example, FIG. 12*a*. In preferred embodiments, the proximal taper portion of each flange increases in diameter in a direction extending towards the distal end of grip 2 (see, e.g., FIGS. 12*a* and 12*b*). In addition, in preferred embodiments, flange collet 30 may include external threads that are configured to engage with internal threads of flange lock sleeve 28. In this way, rotating flange lock sleeve 28 may cause the lock sleeve to move longitudinally along flange collet 30 as discussed elsewhere herein.

Figure 13A:
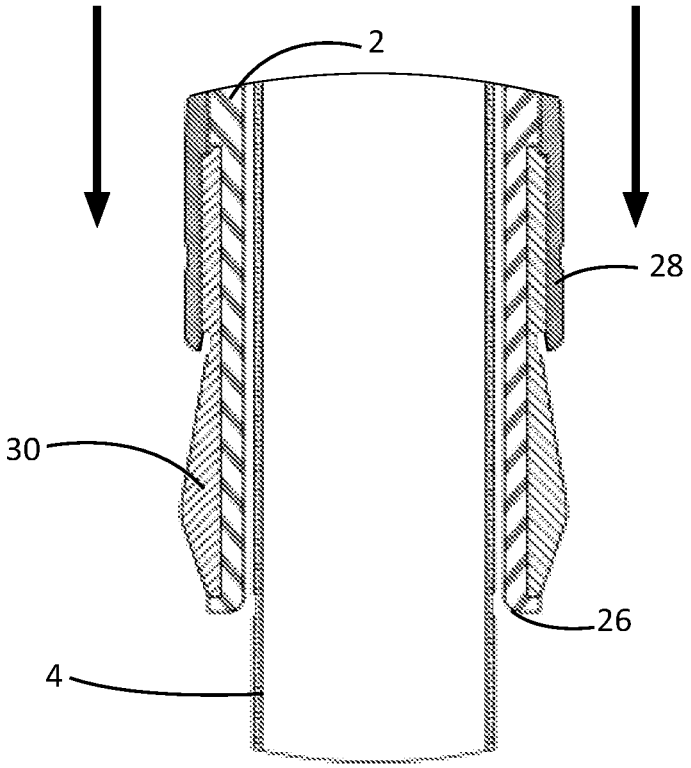
FIG. 13*a* is a side cross-sectional view of the Toe Securing Method B components in a relaxed position according to aspects of certain embodiments of the present invention.
Figure 13B:
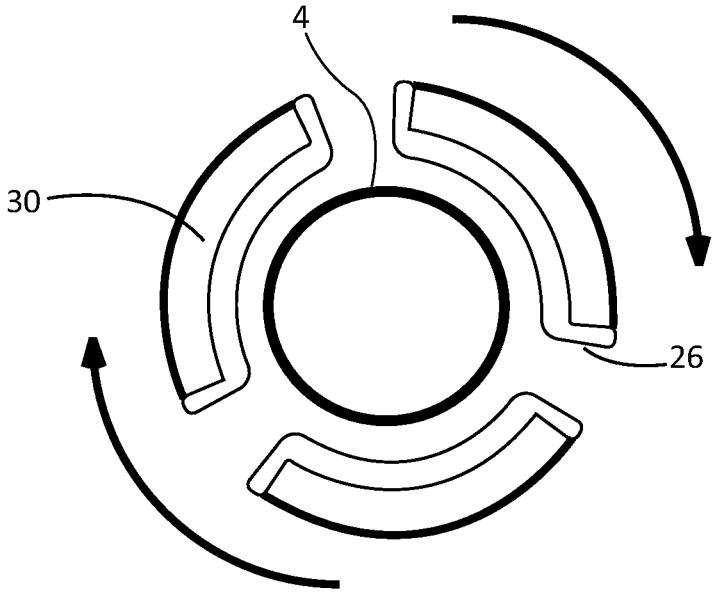
FIG. 13*b* is a top cross-sectional view of Toe Securing Method B components in a relaxed position according to aspects of certain embodiments of the present invention.
Figure 14A:
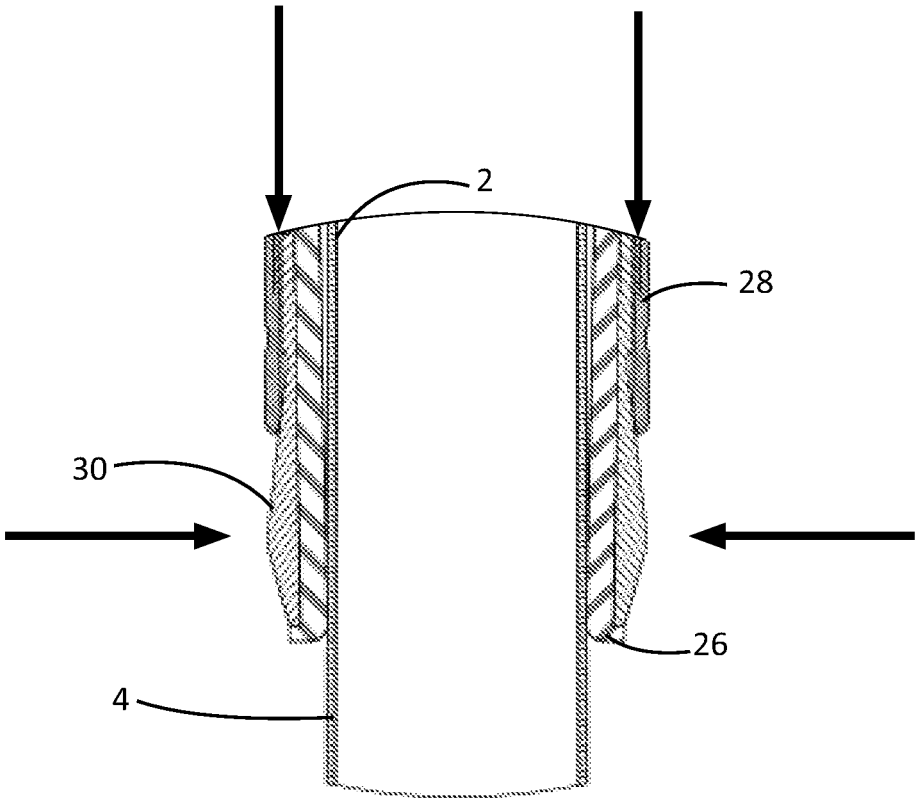
FIG. 14*a* is a side cross-sectional view of the Toe Securing Method B components illustrated in FIG. 13*a* secured to the shaft in a torqued position according to aspects of certain embodiments of the present invention.
Figure 14B:
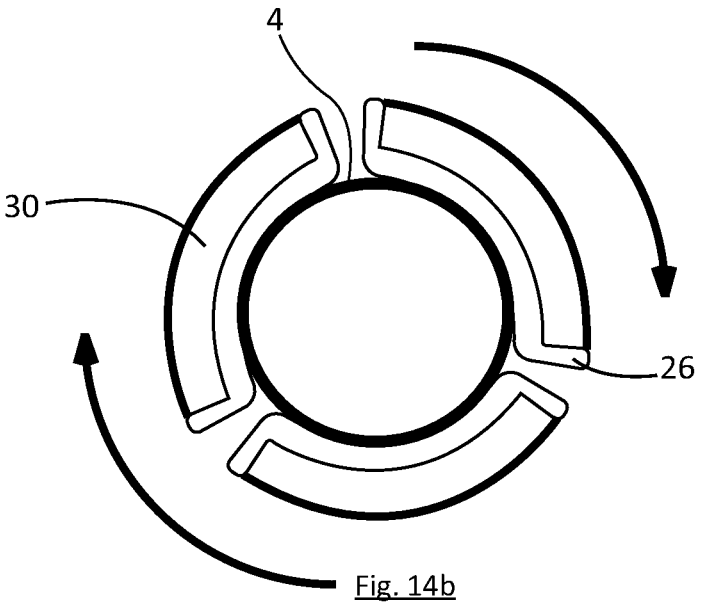
FIG. 14*b* is a top cross-sectional view of the Toe Securing Method B components illustrated in FIG. 13*b* secured to the shaft in a torqued position according to aspects of certain embodiments of the present invention.

FIG. 12*b* is an isometric cross-sectional view of the lower grip portion illustrated in FIG. 12*a* with internal, non-visible toe components 36 specifically relating to Toe Securing Method B according to aspects of certain embodiments of the present invention. FIGS. 13*a* and 13*b* are a detailed side and top cross-sectional views of toe components 36 specifically relating to Toe Securing Method B according to aspects of certain embodiments of the present invention showing flange collet 30 in a relaxed position. FIGS. 14*a* and 14*b* are side and top cross-sectional views of toe components 36 specifically relating to Toe Securing Method B when in the torqued secured position, according to aspects of certain embodiments of the present invention.

Figure 26:
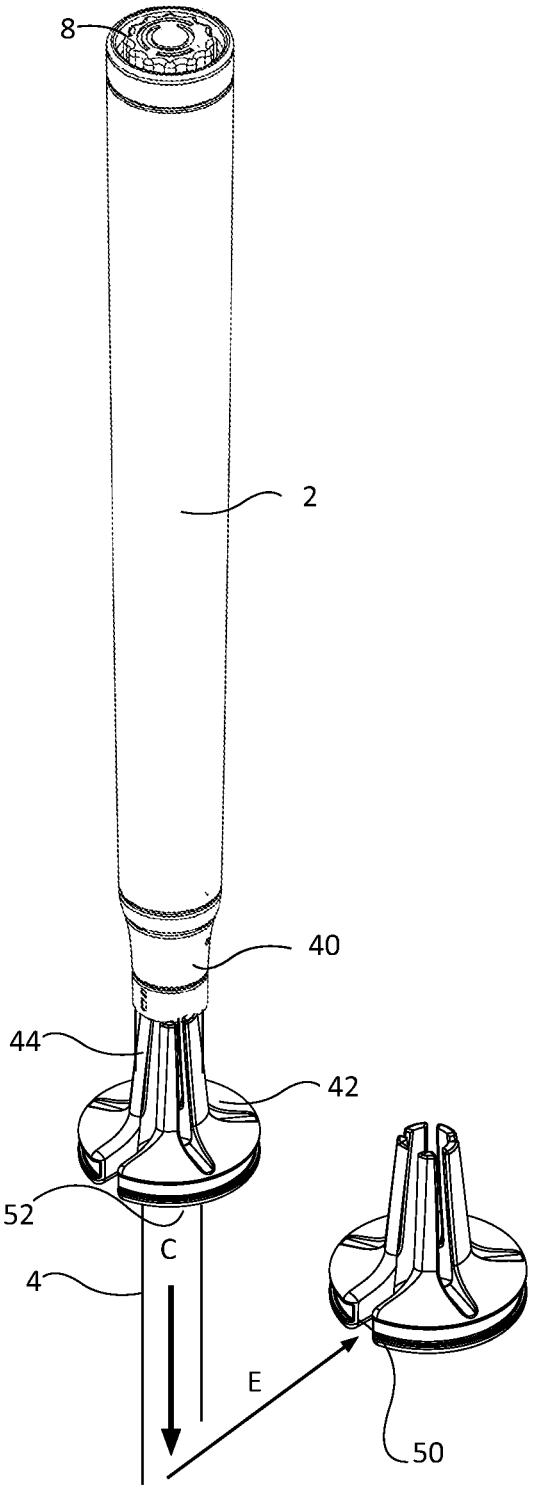
FIG. 26 is a perspective view of the grip sleeve and the securing tool relative to the shaft during Toe Securing Method C, according to aspects of certain embodiments of the present invention.

Toe Securing Method C can be understood from FIG. 26, which is a perspective view of the grip sleeve and the securing tool relative to the shaft during Toe Securing Method C, and FIGS. 25*a-e*, which are cross sectional side views showing successive positions of the internal, non-visible Toe Securing Method C components according to aspects of certain embodiments of the present invention that are used for toe securing method C.

As illustrated in FIG. 26, in some embodiments, the lower, distal portion of grip 2 may include, for example, a Reduced Diameter Sleeve 40 having an internal diameter smaller than that of any part of shaft 2. The Reduced Diameter Sleeve 40, which is located at the lower, distal portion of grip 2, makes up the toe components 36 for Toe Securing Method C when the lower, distal portion of grip sleeve is being secured onto the upper, proximal portion of the shaft using the securing tool. FIGS. 25*a-e* show successive positions of the Toe Securing Method C components when the lower, distal portion of grip sleeve is being secured onto the upper, proximal portion of the shaft using the securing tool, which functions as an insertion device or tool.

FIGS. 25*a* and 25*b* show insertion of the upper functional end of securing tool 42, having a group of radial patterned flexible prongs 44, that is inserted into the Reduced Diameter Sleeve 40 of the lower, distal portion of the grip 2, in the direction of arrow A, by which the internal diameter of Reduced Diameter Sleeve 40 is expanded, in the direction of arrows B, so as to be greater than outer diameter of the upper proximal portion of shaft 4. In certain embodiments, flexible prongs 44 on the upper functional end of securing tool 42 are replaced with a group of radial patterned flanges. In either embodiment, the prongs 44 or flanges serve to assist in expanding the internal diameter of Reduced Diameter Sleeve 40 at its most distal end so that it can be fit over the upper proximal portion of shaft 4.

Once securing tool 42 is inside the lower distal portion of Reduced Diameter Sleeve 40, stretching its internal diameter, the user slides securing tool 42 and Reduced Diameter Sleeve 40, in the direction of arrow C, over the upper proximal portion of shaft 4 until shaft 4 is completely situated within gripping sleeve 40.

Figure 31:
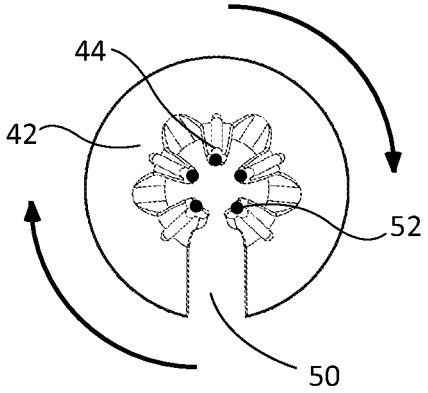
FIG. 31, similar to FIG. 29, is a top sectional view of the Heel Securing Method D, showing the movements required to secure the upper, distal portion of the grip to the shaft, with the addition of the use of the securing tool and its relation to the grip sleeve, according to aspects of certain embodiments of the present invention.

Securing tool 42 has an internal protruding spline 52 on the inside of each prong 44, according to aspects of certain embodiments of the present invention. As illustrated in FIG. 25*c* (and also in FIG. 31), because shafts 4 can be made from different materials and sizes, the internal protruding spline 52 has a protruding profile that serves to reduce friction of the prongs 44 against shaft 4 when shaft 4 is pushed into gripping sleeve 40. Protruding spline 52 could have of any low friction co-efficient material, such that protruding splines 52 assist in easily sliding securing tool 42, inside of Reduced Diameter Sleeve 40, over the upper proximal portion of shaft 4.

Once the upper proximal portion of shaft 4 is completely situated within gripping sleeve 40, such that the upper, proximal portion of shaft 4 is located within the butt end of the upper, proximal portion of the gripping sleeve 2, securing tool 42 may be pulled from within the Reduced Diameter Sleeve 40 by moving it downward, in the direction of arrow C, as illustrated in FIG. 28*d*. The Reduced Diameter Sleeve 40 is now firmly secured onto shaft 4 though frictional force, due to the contraction of the internal diameter of Reduced Diameter Sleeve 40 back to its original state.

As shown best in FIG. 26, once securing tool 42 has been pulled from within the Reduced Diameter Sleeve 40, it can be removed off the shaft 4 altogether using though gap or split opening 50. In order to be able to remove securing tool 42 off shaft 4, split opening 50 must have a clearance greater than the largest diameter of the lower distal portion of shaft 4, so that shaft can pass through split opening 50 in securing tool 42.

Toe Components 36 (by way of Toe Securing Methods A, B and C) each of which is located at the lower, distal portion of grip 2 and, together with, inter alia, heel components 34 (by way of Heel Securing Methods A, B and C), operate to aid attaching and detaching grip 2 from shaft 4 in installed and uninstalled configurations, respectively. These two securing movements of the upper, proximal portion of grip 2, and lower, distal portion of grip 2, can be executed in no particular order of operation. Both portions of grip 2 are required to be secured to shaft 4, before Rotational Movement #3 can be performed. Methods of securing these said portions of grip 2 to shaft 4, are referenced in more detail herein.

The following is a discussion on the actions for heel securing motions and toe securing motions of grip 2 to a shaft 4.

Grip 2 of the present invention may be fastened to any size shaft in, for example, three (3) separate securing movements, wherein the final securing movement is preferably rotational. Any and all rotational securing methods need to be on the same axis of rotation as shown in, for example, FIGS. 17*a*, 17*b* and 17*c*. In certain embodiments, core 5 of grip 2 is can be unlike the cores of conventional grips. As discussed elsewhere herein, core 5 of the current invention may include a star tooth design that may run the whole length of the grip sleeve's internal surface. The core 5 may have a variety of internal design patterns such as a smooth, textured, sine wave and/or rippled profile, which, when torqued with an appropriate amount of rotations, will increase frictional forces to facilitate securing grip 2 to shaft 4. A cross-section view of the core 5 variations is illustrated in, for example, FIGS. 23*a*, 23*b*, 23*c*, 23*d*, and 23*e*.

Figures 17A, 17B, 17C:
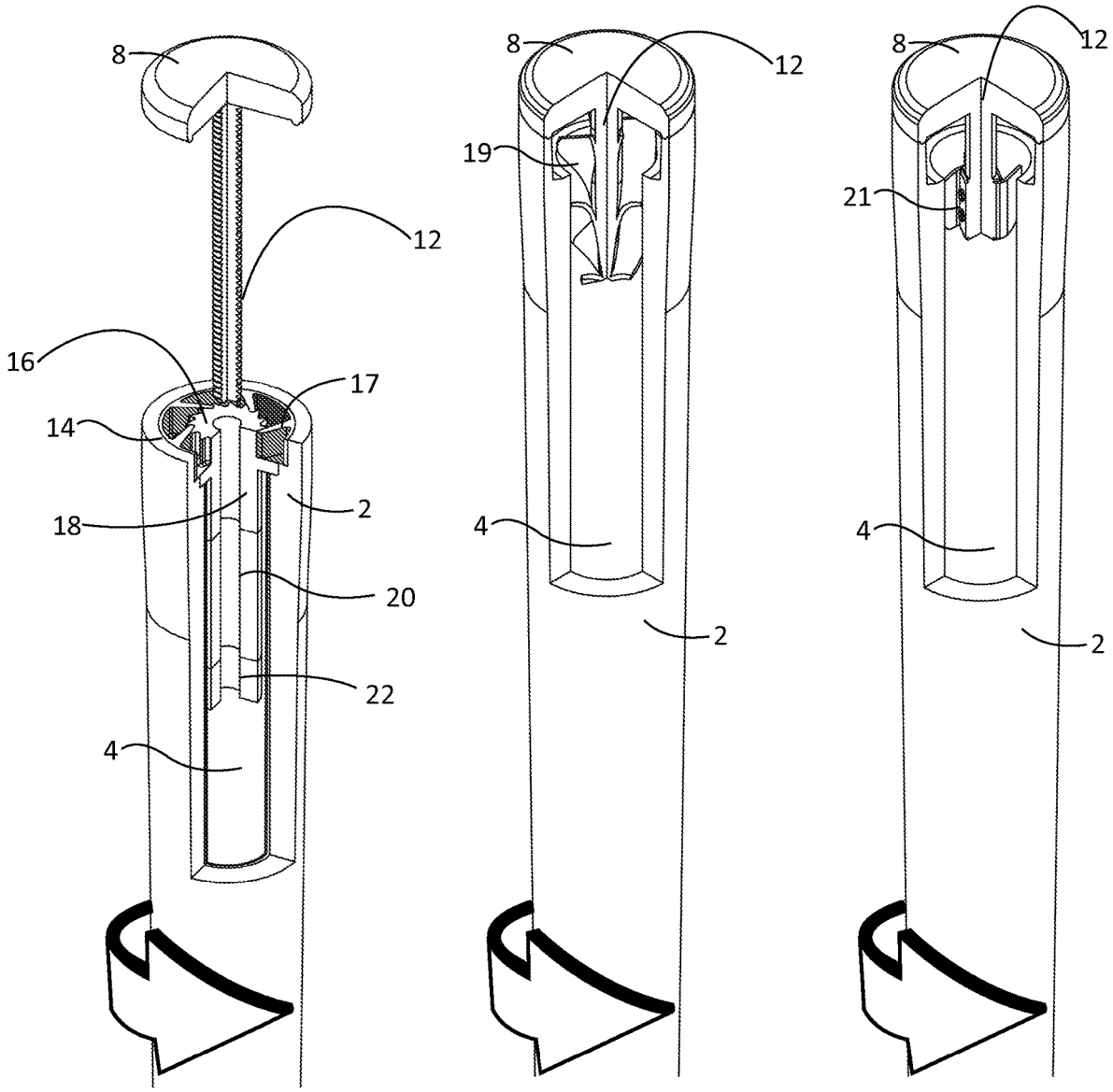
FIG. 17*a* is a partial sectional perspective view of Rotational Movement 3A, according to aspects of certain embodiments of the present inventions.
FIG. 17*b* is a partial sectional perspective view of Rotational Movement 3B, according to aspects of certain embodiments of the present inventions.
FIG. 17*c* is a partial sectional perspective view of Rotational Movement 3C, according to aspects of certain embodiments of the present inventions.

Once the grip is positioned on the shaft, it is automatically centered on the shaft by the internal heel components 34 or otherwise referenced as Heel Securing Methods as the upper, proximal end of the grip sleeve 2 (see, e.g., FIGS. 17*a*, 17*b*, and 17*c*).

In preferred embodiments, heel components 34 are required to be secured to the upper, proximal end of shaft 4. There are several disclosed methods by which means securing grip 2 through components 34. Discussed in further detail below are the actions required, according to aspects of certain embodiments of the present invention. (see FIGS. 4*a*, 4*b*, and 4*c*).

In preferred embodiments of Heel Securing Method A, grip 2 of the current invention may include an expandable tube 20. Said expandable tube 20 is made of a flexible material such as, for example, rubber, although other materials are contemplated. In this embodiment, when grip cap 8 is twisted (e.g., rotated), either by hand or with securing tool 42 engaged into grip cap 8, lead screw 12, which engages with compression nut 22, draws compression nut housing 22 into expandable tube 20, which is then pressed against the bottom surface of ratchet gear hub 18, as shown in, for example, FIGS. 5*a*, 5*b*, 30 and 32. In this way, as lead screw 12 is tightened via grip cap 8 (either by hand or with securing tool 42 engaged into grip cap 8), expandable tube 20 expands within shaft 4, which secures (e.g., locks) heel components 34 specifically relating to Heel Securing Method A, and thus grip 2, onto shaft 4.

In preferred embodiments of Heel Securing Method B, grip 2 of the current invention may include a tapered helix insert 19 (see FIGS. 6 and 6*a*), which may be made of a flexible material such as, for example, plastic or spring steel, although other materials are contemplated. In this embodiment, when grip cap 8 is pressed into inner cavity of upper, proximal portion of shaft 4 (e.g., downward pressure), tapered helix 19 engages with compression against the inner surface of shaft 4, which secures (e.g., locks) heel components 34 specifically relating to Heel Securing Method B, and thus grip 2, onto shaft 4.

In preferred embodiments of Heel Securing Method C, grip 2 of the current invention may include a multi prong spring nut 21 (See FIGS. 7 and 7*a*), which may be is made of a flexible material such as, for example, plastic or spring steel, although other materials are contemplated. In this embodiment, when grip cap 8 is pressed into inner cavity of upper, proximal portion of shaft 4 (e.g., downward pressure), the spring nut 21 engages with compression against the inner surface of shaft 4, which secures (e.g., locks) heel components 34 specifically relating to Heel Securing Method C, and thus grip 2, onto shaft 4.

In preferred embodiments, now the grip 2 is secured at the upper, proximal portion and is automatically centered on the shaft by the internal heel components 34 or otherwise referenced HSMs as discussed elsewhere herein (see, e.g., FIGS. 17*a*, 17*b*, and 17*c*).

Next, in certain embodiments, toe components 36 are required to be secured to the lower, distal end of shaft 4. There are several disclosed methods by which means securing grip 2 through components 36. Discussed in further detail below the actions required, according to aspects of certain embodiments of the present invention (see FIGS. 8*a*, 8*b* and 26).

In preferred embodiments of Toe Securing Method A, grip 2 may be connected at the lower, distal end of the grip sleeve 2 via flexible elongated strap 25 with an embedded securing surface 27 (see, e.g., FIGS. 9*a*, 9*b* and 9*c*). In some embodiments, flexible elongated strap 25 preform as a "torsional wrap". This movement allows flexible strap 25 to compress around the shaft 4 and the bottom, portion of grip 2, as it is wrapped around both said bodies. Securing surface 27 acts as a termination point for flexible strap 25, to be secured onto itself locking toe components 36 specifically relating to Toe Securing Method A against shaft 4. FIGS. 9*a*, 9*b*, and 9*c* show a relaxed position, an in-process torqued position and a fully torqued position, respectively.

Toe Securing Method A is rotated (co-axially) with Rotational Movement #3, discussed hereinbelow. Both movements, Toe Securing Method A and Rotational Movement #3, are in like directions, thereby creating a high torque compression on components 36 (see FIGS. 9*c*, 11*a*, and 11*b*), according to aspects of certain embodiments of the present invention.

Additionally, in certain embodiments, "v" split 29, which allows lower, distal portion of grip 2, to have a smaller diameter and flex over the greater diameters occurring in shaft 4 (e.g., FIGS. 2*a* and 2*b*). Furthermore, "v" split 29 allows the lower, distal portion of gripping sleeve 2 to have less material to compress when securing to the shaft 4, due to the smaller diameter on core 5 design.

In preferred embodiments of Toe Securing Method B, grip 2 may be connected at the lower, distal end of the grip sleeve via flange collet 30 (see, e.g., FIGS. 12*a*, 12*b* and 13*a*). In some embodiments, flange collet 30 is configured to fasten down toe components 36 specifically referencing Toe Securing Method B of grip 2 on shaft 4 via threaded flange lock sleeve 28 and the tapered shoulders of flange collet 30. In preferred embodiments, flange collet 30 may include external threads that are configured to engage with internal threads of flange lock sleeve 28. In this way, rotating flange lock sleeve 28 may cause the lock sleeve to move longitudinally along flange collet 30. Thus, rotating (e.g., tightening) flange lock sleeve 28 on flange collet 30 causes flange lock sleeve 28 to strike the tapered shoulders of each flange on flange collet 30 that, in turn, causes each flange to compress and tighten onto shaft 4. In certain embodiments, the complimentary threads on flange collet 30 and flange lock sleeve 28 may allow for a large range of motion thus allowing toe components 36 specifically referencing Toe Securing Method B to tighten onto a wide range of varying diameters of shafts, such as shown in, for example, FIGS. 13*a*, 13*b*, 14*a* and 14*b*.

In preferred embodiments, threaded flange lock sleeve 28 is mounted onto flange collet 30. Threaded flange lock sleeve 28 may be made of aluminum, but it is contemplated that sleeve 28 may be made of any rigid metallic, composite or polymer material that may support an internal thread (see, e.g., FIGS. 12*a* and 12*b*).

In certain embodiments, threaded flange lock sleeve 28 is positioned onto grip 2 as a free standing part, but is not limited to being a free standing part. For example, threaded flange lock sleeve 28 may also be attached to, or housed on, grip 2 or, in other embodiments, on flange collet 30.

Figure 15A:
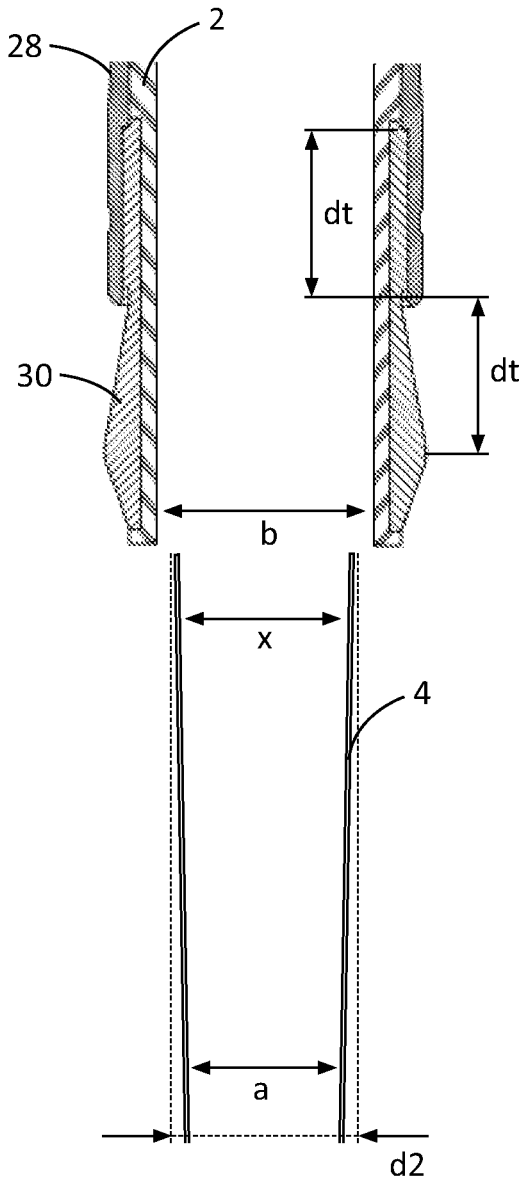
FIG. 15*a* is an illustration of dimensional perimeters before the rubber is secured on the shaft end, according to aspects of certain embodiments of the present invention.
Figure 15B:
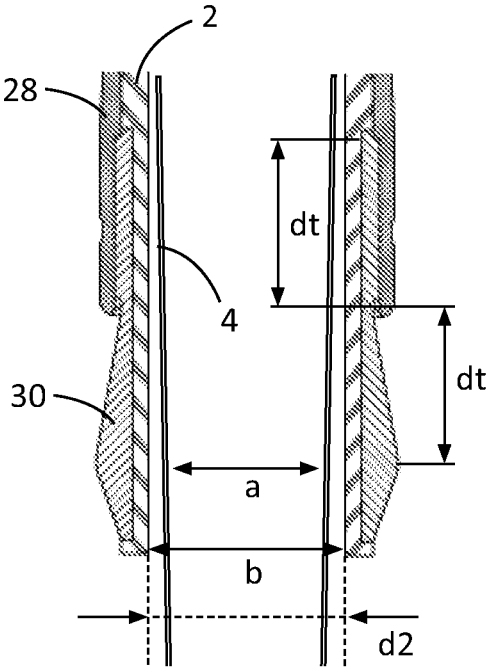
FIG. 15*b* is an illustration of dimensional perimeters once the rubber is secured on the shaft end, and outlining all movements required to move the rubber over the shaft according to aspects of certain embodiments of the present invention.

In some embodiments, the lower portion of threaded flange lock sleeve 28 has a matching internal taper that corresponds with the external taper of flange collet 30 (see, e.g., FIGS. 15*a* and 15*b*). This taper is designed to reduce friction as flange lock sleeve 28 rotates over flange collet 30, thereby compressing flange collet 30 and flange housing 26. The height of the angle of taper of flange collet 30 determines the range of compression on to shaft 4, which may have a variety of shaft diameters. The taper angle length is a product of the distance of travel needed for threaded flange lock sleeve 28 threaded over flange collet 30, as shown in, for example, FIGS. 15*a* and 15*b*.

As shown in FIGS. 15*a* and 15*b*, shaft 4 has an upper diameter x and a lower diameter a, with a shaft draft angle of y. Grip 2 has a lower internal diameter b and an upper internal diameter c. Flange collet 30 has a distance of compression d and a distance of thread dt.

For example, flange collet 30 will compress onto flange housing 26, reducing flange housing 26 from an approximately 16.3 mm internal diameter to an approximately 13.8 mm internal diameter, and fastening grip 2 to shaft 4 within that range. In preferred embodiments, the internal diameters between 13.8 mm and 16.3 mm are designated to match the maximum and minimum diameters at the end portion of shaft 4, which allows grip 2 to slide over all varying diameters with little force. In some embodiments, flange collet 30 is not confined to specific dimensions, as shown in, for example, FIGS. 12 and 13, and the angle taper of flange collet 30 may be decreased or increased depending on the internal diameters needed. When the internal threads of lock sleeve 28 are twisted over the corresponding external threads of flange collet 30, toe components 36 will fasten grip 2 onto shaft 4. It is contemplated that, when grip 2 is secured in position, no additional rotation or longitudinal movement of flange lock sleeve 28 will be allowed (see, e.g., FIGS. 14*a* and 14*b*). That is, in some embodiments, flange lock sleeve 28 and flange collet 30 may include a stop mechanism that may disallow further rotational and longitudinal movement of lock sleeve 28 over flange collet 30 to prevent over-tightening or to prevent lock sleeve 28 from slipping off of flange collet 30.

In some embodiments the internal surface of flange housing 26 (which, in some embodiments, may be equivalent or similar to the internal surface of core 5) may have a high coefficient of friction to prevent grip 2 from moving on shaft 4 once each flange of flange collet 30 is tightened onto shaft 4. For example, flange housing 26 may include a coarse surface, an adhesive surface, or otherwise be made of a material with a high coefficient of friction.

In preferred embodiments of Toe Securing Method C, grip 2 may be connected at the lower, distal end of the grip 2 via a Reduced Diameter Sleeve 40 having an internal diameter smaller than any external diameter of shaft 2. In conjunction with the use of the upper functional end of securing tool 42, where prongs 44 are inserted into the Reduced Diameter Sleeve 40 at the lower distal portion of grip 2, the internal diameter of Reduced Diameter Sleeve 40 is expanded to be greater than the external diameter of the upper proximal portion of shaft 4.

With the aid of Protruding Splines 52 in reducing friction the securing tool 42, which is fit inside Reduced Diameter Sleeve 40, is then slid over the upper, proximal portion of shaft 4. Securing tool 42 is then slipped out from within the Reduced Diameter Sleeve 40 once the upper, proximal portion of the gripping sleeve 2 is fit over the butt end of the upper, proximal portion of shaft 4. Once securing tool 42 is removed from between Reduced Diameter Sleeve 40 and the lower, distal portion of shaft 4, Reduced Diameter Sleeve 40 is firmly secured onto shaft 4 though frictional force, by the contraction of rubber at the distal end of Reduced Diameter Sleeve 40 contract to its original state around shaft 4.

In some embodiments the internal surface of the Reduced Diameter Sleeve 40 (which, in some embodiments, may be equivalent or similar to the internal surface of core 5) may have a high coefficient of friction to prevent grip 2 from moving on shaft 4. For example, it may also include a coarse surface or an adhesive surface, or otherwise be made of a material with a high coefficient of friction.

Furthermore, the removing of securing tool 42 off shaft 4 though split opening 50 may be accomplished if split opening 50 has a greater clearance than that of the largest diameter of the lower distal portion of shaft 4. Removing securing tool 42 completely from the gripping sleeve 2 and shaft 4, according to certain embodiments of the invention, is referenced in FIG. 26.

Figure 16:
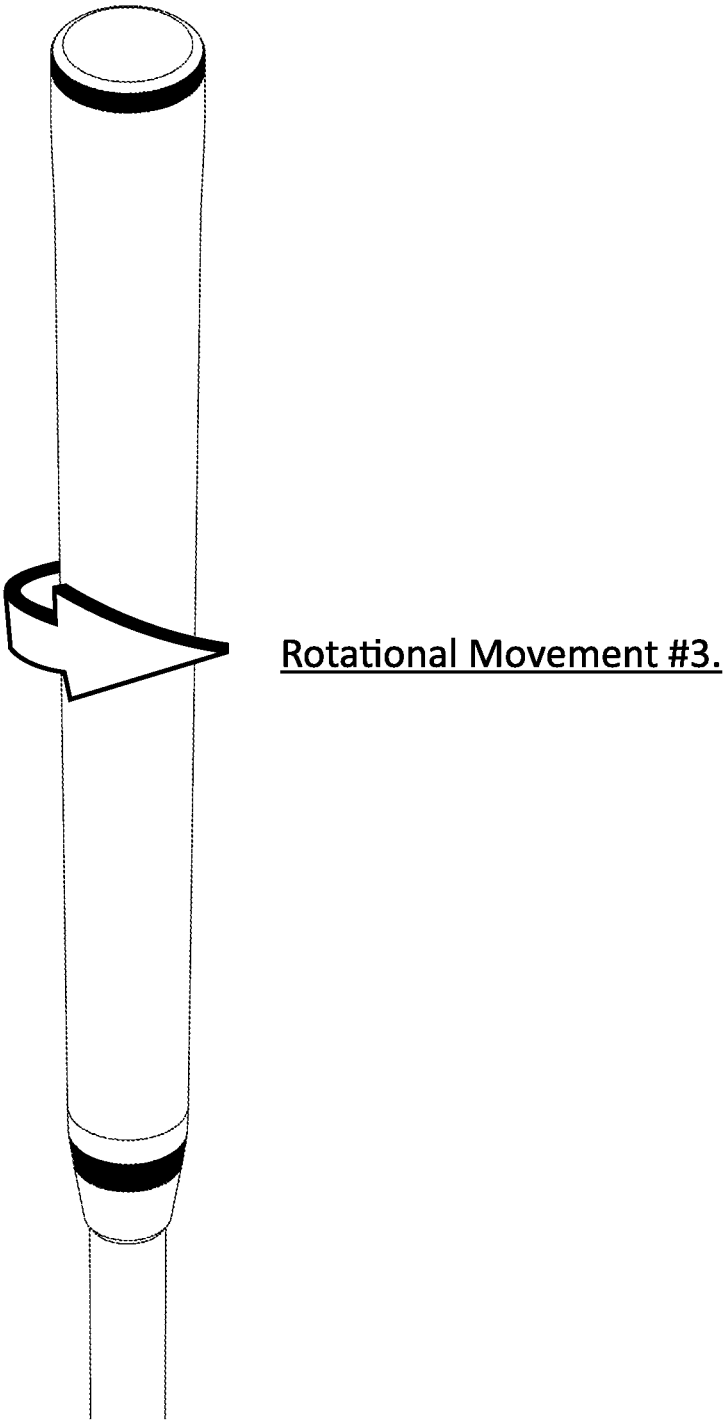
FIG. 16 is a perspective view of the grip and the final rotational movement that secures the grip to shaft after both Securing Methods 1 and Securing Methods 2 have been carried out, according to aspects of certain embodiments of the present invention.

Reference is now made to FIG. 16, which is an isometric view of grip 2 and which, as discussed elsewhere herein, illustrates the final and key element to securing grip 2 onto shaft 4, namely Rotational Movement #3, which occurs after heel components 34 are secured to shaft 4 using one of the Heel Securing Movements and after toe components 36 are secured to shaft 4 using one of the Toe Securing Movements. Rotational Movement #3 is a rotational movement, which contracts the internal diameter of grip sleeve 2 onto shaft 4. Thus, in preferred embodiments, when the sleeve of grip 2 is twisted, core 5 is compressed onto shaft 4, which fastens grip 2 onto shaft 4 with a stability that is comparable to the stability of a conventional grip (see, e.g., FIGS. 21*a*, 21*b*, 22*a*, and 22*b*).

FIGS. 17*a*, 17*b* and 17*c* show a variety of rotational movements for securing grip 2 onto shaft 4, referred to as Rotational Movements 3A, 3B and 3C, respectively. Rotational Movements #3 as referenced in FIGS. 17*a*, 17*b*, and 17*c* all require the same user action of twisting (i.e., rotating) grip sleeve 2, around shaft 4. However, due to the slight differences in Heel Securing Methods used, they vary internally from each other, as described in more detail hereinbelow.

Figure 18A:
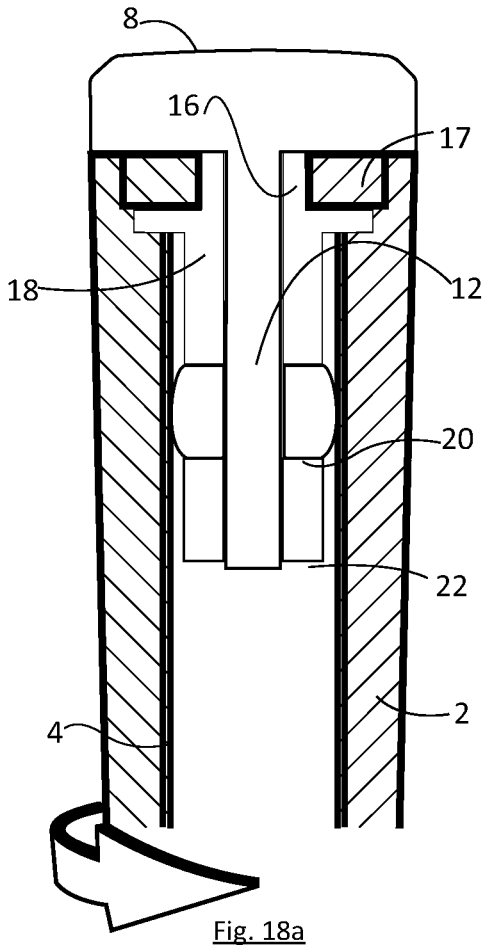
FIG. 18*a* is a side cross-sectional view of the Rotational Movement 3A components in the required rotational movements to secure rubber grip onto shaft, according to aspects of certain embodiments of the present invention.
Figure 18B:
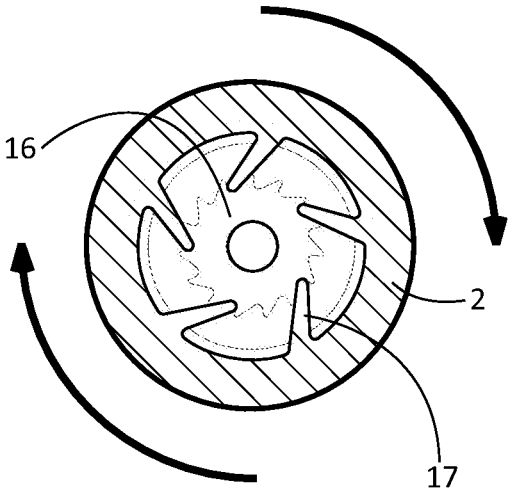
FIG. 18*b* is a top cross-sectional view of the Rotational Movement 3A components in the required rotational movements to secure rubber grip onto shaft, according to aspects of certain embodiments of the present invention.

Rotational Movement 3A can be understood from FIG. 17*a*, which shows an embodiment in which a portion of ratchet gear hub 18 and ratchet gear 16 are located (e.g., co-axially) within ratchet paw housing 14 at the terminal, proximal end of the sleeve of grip 2. In certain embodiments, ratchet paw housing 14 may be embedded within, or otherwise connected to, the grip sleeve as shown in FIGS. 18*a* and 18*b*, and may include one or more ratchet arms radially extending towards a center of ratchet paw housing 14 and configured to engage with ratchet gear 16. As is known in the art, ratchet gear 16 may include a plurality of teeth, and the ratchet arm of ratchet paw housing 14 may be configured to engage with each of the plurality of teeth in such a way that ratchet gear 16 may rotate in one direction only.

FIGS. 18*a* and 18*b* show side and top cross-sectional views, respectively, of grip 2 showing the movements relating to Rotational Movement 3A for securing grip 2 onto shaft 4 according to aspects of certain embodiments of the present invention. Rotational Movement 3A is the specific rotational movement used for the mechanism of Heel Securing Method A. In certain embodiments, ratchet paw housing 14 may include one or more ratchet arms 17 that radially extend towards a center of ratchet paw housing 14, which is configured to engage with the plurality of teeth on ratchet gear 16 in such a way that ratchet gear 16 may rotate in one direction only.

As such, in certain embodiments, once heel components 34 and toe components 36 are fixed firmly to shaft 4, ratchet paw housing 14 may be configured to rotate freely in one direction around ratchet gear 16 by rotating the grip sleeve (see, e.g., FIG. 18*b*). Rotating the grip sleeve of grip 2 causes the internal diameter (e.g., core 5) of the grip sleeve to contract as shown in, for example, FIGS. 22*a* and 22*b*. In preferred embodiments, the ratchet mechanism of ratchet paw housing 14*a*, by virtue of radially extending ratchet arms 17 engaging with ratchet gear 16, prevents the opposite rotation, and thus loosening, of the grip sleeve. Thus, when the sleeve of grip 2 is twisted, core 5 is compressed onto shaft 4, which fastens grip 2 onto shaft 4 with a stability that is comparable to the stability of a conventional grip (see, e.g., FIG. 16).

In some embodiments, ratchet paw housing 14 location in Heel Securing Method A may be a plastic housing, although other types of materials, such as other polymers or metals that may rotate as a solid body with the grip sleeve about the longitudinal axis of grip 2, are contemplated.

In some embodiments, ratchet gear 16 may be part of the same single body including ratchet gear hub 18 (see, e.g., FIGS. 17*a*, 18*a* and 18*b*), although it is contemplated that ratchet gear 16 and ratchet gear hub 18 may be also be separate and distinct pieces. In preferred embodiments, twisting the grip sleeve of grip 2 also turns ratchet paw housing 14 around ratchet gear 16, thereby allowing the grip sleeve of grip 2 to tighten on a ratchet system, which allows the grip sleeve to rotate or twist in a single direction only without any movement in the opposite direction due to the restriction causes by the ratchet mechanism. In preferred embodiments, the ratchet mechanism allows the user to continually tighten the grip sleeve until the internal diameter of core 5 has tightened or closed securely around shaft 4 (see, e.g., FIGS. 22*a* and 22*b*). There will be no slip, lateral movement or longitudinal movement once grip 2 has been torqued into the torqued configuration as shown in, for example, FIG. 22*a*.

Figure 19A:
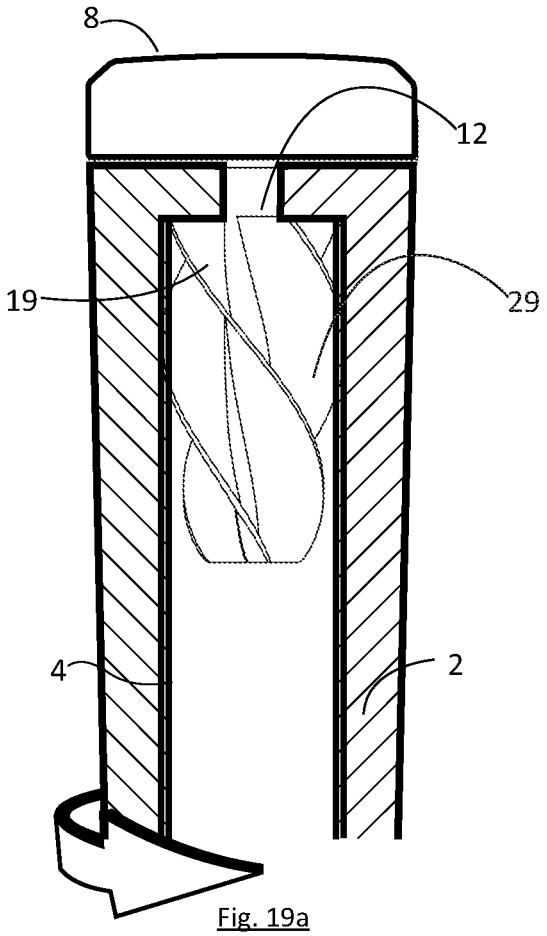
FIG. 19*a* is a side cross-sectional view of the Rotational Movement 3B components in the required rotational movements to secure rubber grip onto shaft, according to aspects of certain embodiments of the present invention.
Figure 19B:
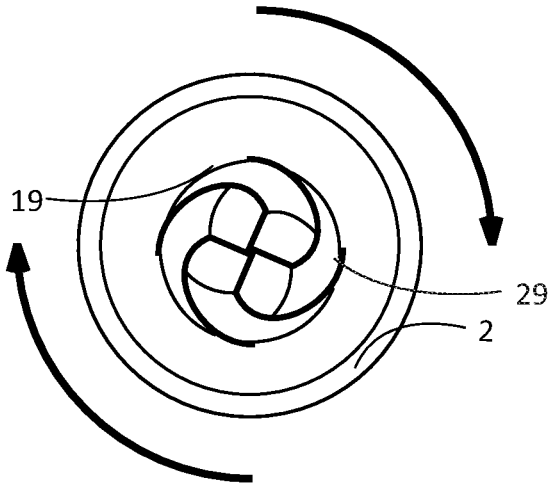
FIG. 19*b* is a top cross-sectional view of the Rotational Movement 3B components in the required rotational movements to secure rubber grip onto shaft, according to aspects of certain embodiments of the present invention.

Rotational Movement 3B can be understood from FIG. 17*b*, which shows an embodiment in which tapered helix insert 19 is located (e.g., co-axially) within the terminal, proximal end of the sleeve of grip 2. In certain embodiments, tapered helix insert 19 may be embedded within, or otherwise connected to, the grip sleeve 2 as shown in FIGS. 19*a* and 19*b*, such as by being affixed to the grip sleeve 2 via grip cap 8, e.g., by polymer bonding or some other suitable adhesive. Tapered helix insert 19 may include one or more spirally arranged helix arms configured to engage with an inside surface of shaft 4 in such a way that tapered helix insert 19 may rotate in one direction only.

FIGS. 19*a* and 19*b* show top and side cross sectional views, respectively, of grip 2 showing the movements relating to Rotational Movement 3B for securing grip 2 onto shaft 4 according to aspects of certain embodiments of the present invention. Rotational Movement 3B is the specific rotational movement used for the mechanism of Heel Securing Method B. In certain embodiments, grip 2 is affixed to grip cap 8, which as discussed above, is engaged with tapered helix insert 19 via lead screw 12. Tapered helix insert 19 may include one or more helix arms 29 spirally arranged thereabout and about radially extending towards a center of the internal core shaft 4, which is configured to engage within shaft 4 in such a way that tapered helix insert 19 may rotate in one direction only.

As such, in certain embodiments, once heel components 34 and toe components 36 are fixed firmly to shaft 4, tapered helix insert 19 may be configured to rotate freely in one direction around the inside of the upper, proximal portion of shaft 4, by rotating grip cap 8 and grip sleeve 2 (see, e.g., FIG. 19*b*). Rotating the grip cap 8 causes the internal diameter (e.g., core 5) of the grip sleeve of grip 2 to contract, as shown in, for example, FIGS. 22*a* and 22*b*, in the same actions of Rotational Movement 3A. In preferred embodiments, tapered helix insert 19, by virtue of helix arms 29 engaging an internal surface of shaft 4, prevents the opposite rotation, and thus loosening, of the grip sleeve. Thus, when the sleeve of grip 2 is twisted, core 5 is compressed onto shaft 4, which fastens grip 2 onto shaft 4 with a stability that is comparable to the stability of a conventional grip (see, e.g., FIG. 16).

Figure 20A:
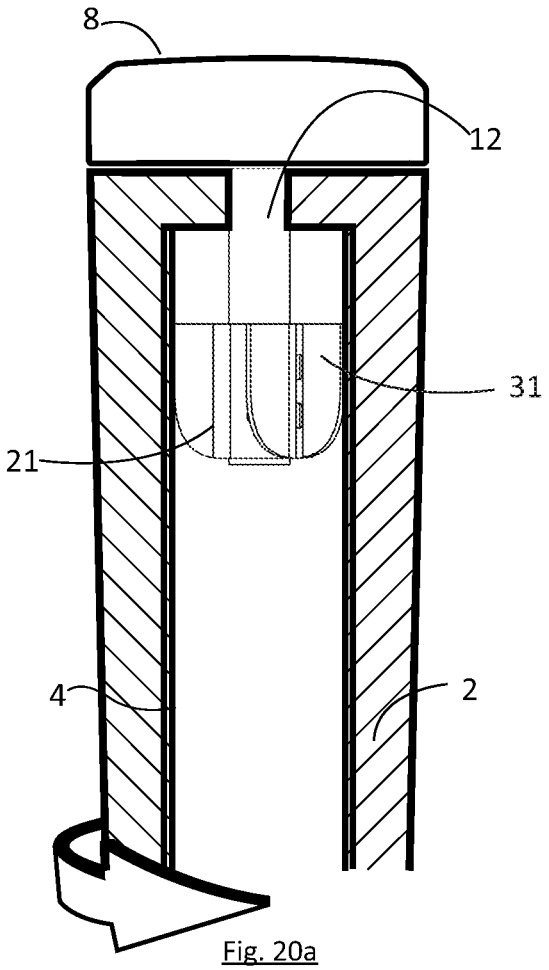
FIG. 20*a* is a side cross-sectional view of the Rotational Movement 3C components in the required rotational movements to secure rubber grip onto shaft, according to aspects of certain embodiments of the present invention.
Figure 20B:
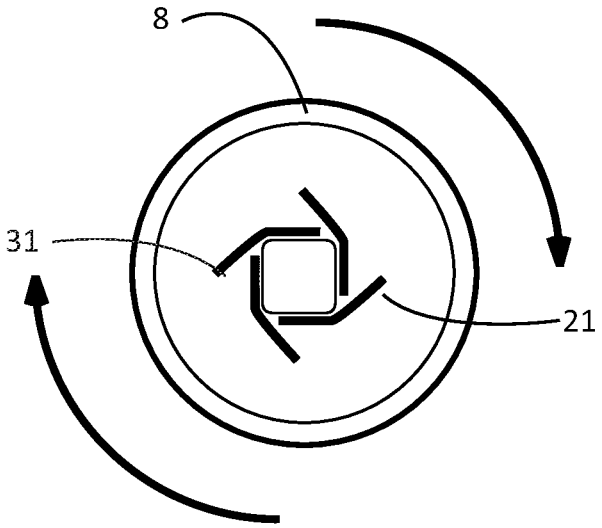
FIG. 20*b* is a top cross-sectional view of the Rotational Movement 3C components in the required rotational movements to secure rubber grip onto shaft, according to aspects of certain embodiments of the present invention.

Rotational Movement 3C can be understood from FIG. 17*c*, which shows an embodiment in which tapered helix insert 19 is located (e.g., co-axially) within the terminal, proximal end of the sleeve of grip 2. In certain embodiments, multi star spring nut 21 may be embedded within, or otherwise connected to, the grip sleeve as shown in FIGS. 20*a* and 20*b*, such as by being affixed to the grip sleeve 2 via grip cap 8, e.g., by polymer bonding or some other suitable adhesive. Multi star spring nut 21 may include one or more radially extending but angled arms configured to engage with an inside surface of shaft 4 in such a way that multi star spring nut 21 may rotate in one direction only.

FIGS. 20*a* and 20*b* show top and side cross sectional views, respectively, of grip 2 showing the movements relating to Rotational Movement 3C for securing grip 2 onto shaft 4 according to aspects of certain embodiments of the present invention. Rotational Movement 3C is the specific rotational movement used for the mechanism of Heel Securing Method C, although very similar to Rotational Movement 3B. In certain embodiments, grip 2 is affixed to grip cap 8, which as discussed above, is engaged with multi star spring nut 21 via lead screw 12. Multi star spring nut 21 may include one or more arms 31 oriented at an angle with respect to a center thereof and radially extending towards a center of the internal core shaft 4, which is configured to engage within shaft 4 in such a way that multi star spring nut 21 may rotate in one direction only.

As such, in certain embodiments, once heel components 34 and toe components 36 are fixed firmly to shaft 4, multi star spring nut 21 may be configured to rotate freely in one direction around the inside of the upper, proximal portion of shaft 4, by rotating grip cap 8 and grip sleeve 2 (see, e.g., FIG. 19*b*). Rotating the grip cap 8 causes the internal diameter (e.g., core 5) of the grip sleeve of grip 2 to contract as shown in, for example, FIGS. 22*a* and 22*b*, in the same actions of Rotational Movements 3A and 3B. In preferred embodiments, multi star spring nut 21, by virtue of arms 31 engaging an internal surface of shaft 4, prevents the opposite rotation, and thus loosening, of the grip sleeve. Thus, when the sleeve of grip 2 is twisted, core 5 is compressed onto shaft 4, which fastens grip 2 onto shaft 4 with a stability that is comparable to the stability of a conventional grip (see, e.g., FIG. 16).

Because toe components 36 are directly connected to the grip sleeve 2 via embedding, molding, adhesion, fusion or the like, grip sleeve 2 will rotate in only one direction around the shaft 4. However, during Rotational Movement #3, toe components 36 and grip sleeve can be rotated separately or together, as shown in, for example, FIGS. 17*a*, 17*b* and 17*c*, and as discussed elsewhere herein. For example, the grip sleeve of grip 2 and certain toe components 36 within the upper, proximal (e.g., the heel) portion of grip 2 are configured to turn or rotate as one single unit.

Figure 21A:
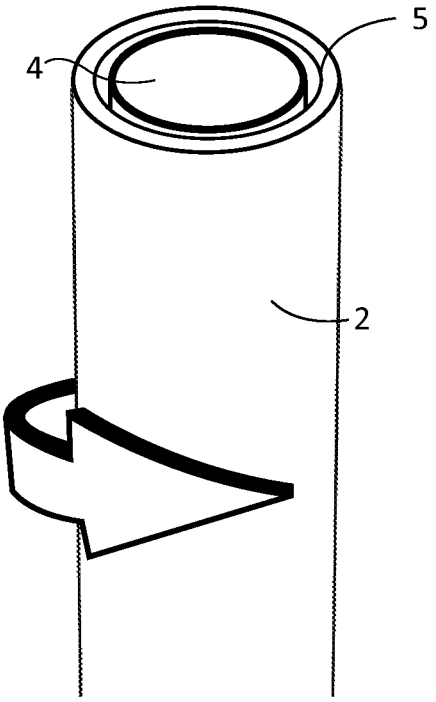
FIG. 21*a* is a sectional isometric view of the grip in the relaxed position, which allows the grip to slide over the shaft before fastening according to aspects of certain embodiments of the present invention.
Figure 21B:
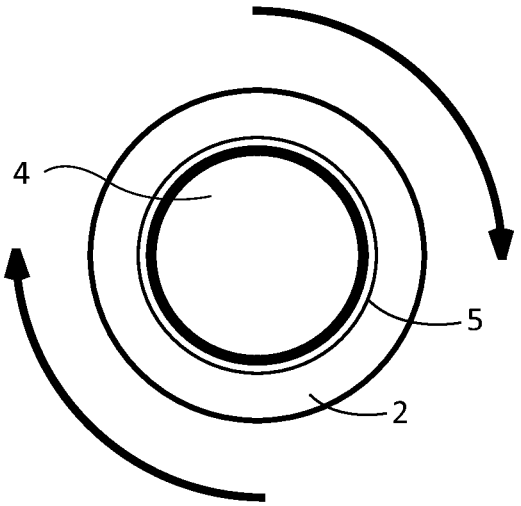
FIG. 21*b* is a top cross-sectional view of the internal features of the rubber grip when the grip is in the relaxed position according to aspects of certain embodiments of the present invention.
Figure 22A:
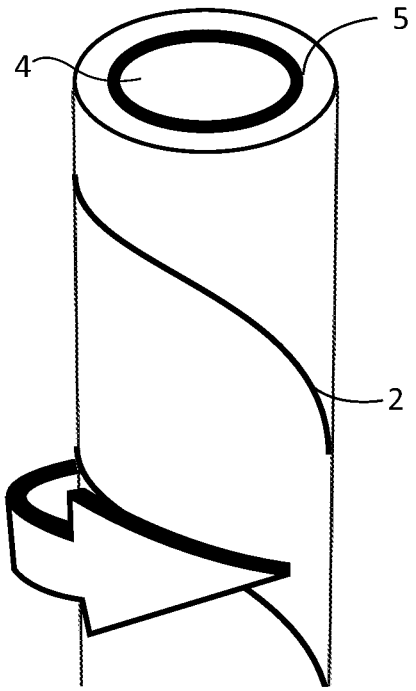
FIG. 22*a* is a sectional isometric view of the grip in the secured position, which fastens grip to the shaft, according to aspects of certain embodiments of the present invention.
Figure 22B:
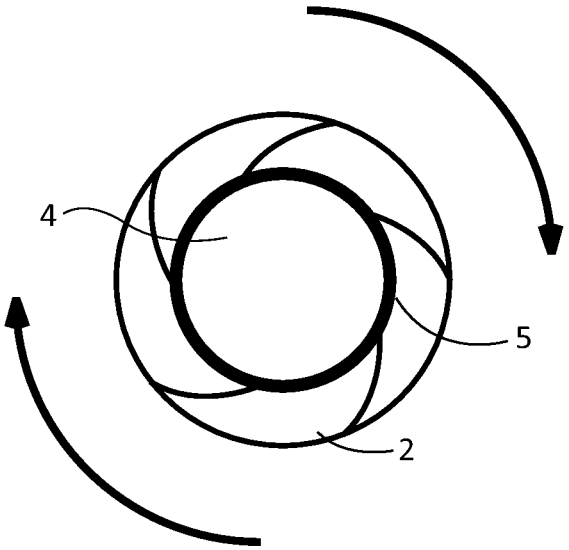
FIG. 22*b* is a top sectional view of the grip in the secured position, which fastens grip to the shaft, according to aspects of certain embodiments of the present invention.
Figure 23A:
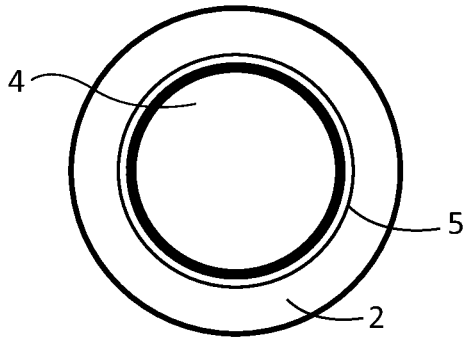
FIG. 23*a* is a top sectional view of the grip with a smooth internal core on the rubber, according to the aspects of certain embodiments of the present invention.
Figure 23B:
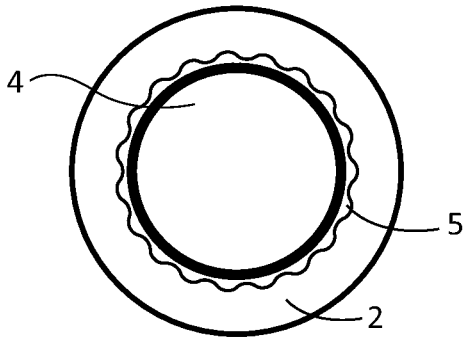
FIG. 23*b* is a top sectional view of the grip with a sin-wave core inside of the rubber, according to the aspects of certain embodiments of the present invention.
Figure 23C:
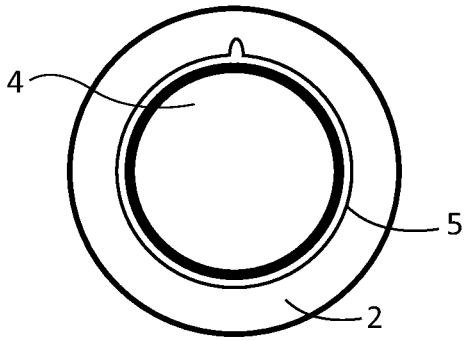
FIG. 23*c* is a top sectional view of the grip with a smooth internal core which has a small spline indentation inside of the rubber, according to the aspects of certain embodiments of the present invention.
Figure 23D:
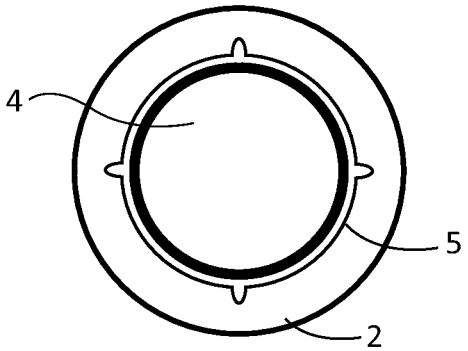
FIG. 23*d* is a top sectional view of the grip with a smooth internal core which has several small spline indentations inside of the rubber, according to the aspects of certain embodiments of the present invention.
Figure 23E:
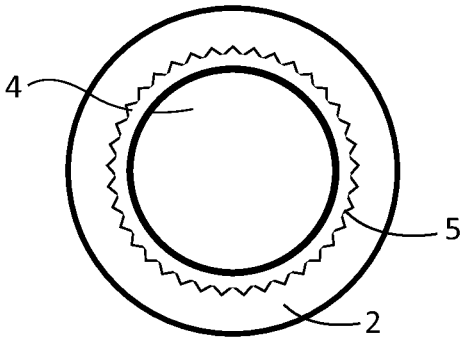
FIG. 23*e* is a top sectional view of the grip with a multiple toothed spline internal core inside of the rubber, according to the aspects of certain embodiments of the present invention.

FIGS. 21*a* and 21*b* show isometric and top cross-sectional views, respectively, of grip 2 in a relaxed, uninstalled position prior to Rotational Movement #3, and FIGS. 22*a* and 22*b* show isometric and top cross-sectional views, respectively, of grip 2 in a torqued, installed position after Rotational Movement #3.

In some embodiments, the grip sleeve of grip sleeve 2 is rotating around shaft 4, thereby decreasing the diameter of the grip sleeve (and thus grip 2) as shown in, for example, FIGS. 21*a*, 21*b*, 22*a* and 22*b*. In some embodiments, gripping sleeve could have a striped design element which completely runs along grip 2. When grip 2 has no visible helix formation, grip 2 is said to be in the relaxed position, which may be a trigger for the user either to apply Rotational Movements #1, #2 and #3 (depending on the state of the various components) or to remove grip 2 from shaft 4. When striped design element is twisted around the grip sleeve and has a visible helix formation, as shown, e.g., FIG. 22*b*, this is an indication that grip 2 is in tension (e.g., the torqued configuration) and that grip 2 is firmly and securely mounted on shaft 4.

In an uninstalled configuration (e.g., when grip 2 is in a relaxed position), as shown in FIGS. 21*a* and 21*b*, the internal core should provide limited or no contact surface area on shaft 4, while, in an installed configuration (e.g., when grip 2 is in a torqued position), as shown in FIGS. 22*a* and 22*b*, the entire surface area of the internal core will compress onto shaft 4 and allow provide grip 2 to be held securely in place on shaft 4.

In some embodiments, as shown in FIGS. 23*a-e*, core 5 (e.g., an inner surface of the grip sleeve) may include, but is not limited to, an extruding tooth-like design having a plurality of protruding teeth or other variations of cores 5. In certain embodiments, the plurality of internal teeth may reduce the internal diameter of core 5 such that core 5 may have an internal diameter that is smaller than the largest possible diameter of shaft 4. However, the reduced surface area of the plurality of internal teeth of core 5 helps ensure that grip 2 may be easily installed on shaft 4. The core 5 can have a variety of internal design patterns such as a smooth (see FIG. 23*a*), textured (see FIGS. 23*c*, 23*d*), sine wave and/or rippled profile (see FIGS. 23*b*, 23*e*), which, when torqued with an appropriate amount of rotations, will facilitate securing grip 2 to shaft 4. However, regardless of the internal shape inside the rubber grip 2, the internal diameter of core 5 must be larger than that of the upper section of shaft 4 (see, e.g., FIGS. 23*a, b, c, d*, and *e*).

In more detail, the method of attachment of grip 2 onto a shaft 4 may be broken into, for example, three (3) basic securing movements (see, e.g., FIG. 3).

Securing Movement #1: As shown in, for example, FIGS. 4*a*, 4*b* and 4*c*, heel components 34 of grip 2 are first positioned onto shaft 4. Securing Movement #1 has been referenced above as Heel Securing Movements, and is separated into different movements due to the use of different fixing heel components 34. The movements required are either rotational torque (Heel Securing Method A), including torque with the use of securing tool 42, or downward pressure (Heel Securing Method B and Heel Securing Method C). Both of these actions result in securing the upper, proximal portion of griping sleeve 2, onto shaft 4. As referenced in FIGS. 5*b*, 6*a*,7*a* and 32, the preferred embodiments, all heel components 34 relating to Heel Securing Movements are required to be secured before the final Rotational Movement #3 can be performed.

Securing Movement #2: As shown in, for example, FIGS. 17*a*, 17*b*, 17*c* and 25, once grip 2 is situated and secured into place on shaft 4 by Securing Movement #1, grip 2 is centered on shaft 4 by fastening toe components 36 at the lower, distal portion of the grip sleeve 2 onto shaft 4. In certain embodiments, fastening toe components 36 to shaft 4 may be similar to Securing Movement #1. Securing Movement #2 has been referenced as Toe Securing Movements and is separated into different movements due to the use of different fixing toe components 36. The movements required are rotational torque, compression and/or friction, but these are not limited to rotational movements, as long as there is a means of securing the lower, distal portion of gripping sleeve 2 onto shaft 4 with or without the additional use of securing tool 42. As referenced in FIGS. 8*a*,8*b* and 26 the preferred embodiments, all toe components 36 relating to Toe Securing Movements are required to be secured before the final Rotational Movement #3 can be performed.

Rotational Movement #3: With both heel and toe embodiments of grip 2 fastened to shaft 4, there is a need to decrease the internal core diameter of the grip sleeve in order to secure grip 2 to shaft 4. Rotational Movement #3 is separated into different movements due to the use of internal diameter reducing structures. In certain embodiments, decreasing the internal core of the grip sleeve may be effected by rotating or twisting the entire grip sleeve body, and an internal mechanism maintains the grip sleeve body in the torqued or twisted position, thereby preventing the grip sleeve body from rotating back. Thus, in certain embodiments, it can be said that grip 2 includes a relaxed configuration or position, and a torqued configuration or position. In preferred embodiments, grip 2 is maintained in the relaxed configuration throughout Securing Movements #1 and #2, and is maneuvered to the torqued configuration upon operation of Rotational Movement #3. As shown in FIG. 3, Rotational Movement #3 can be executed only once both Securing Movement #1 and Securing Movement #2 are complete.

As discussed hereinabove, certain embodiments of the present invention relate to a method for changing or replacing a grip on a shaft (e.g., a golf club shaft) by implementing one or more of the Securing and Rotational Movements #1, #2 and/or #3, as well as one or more of Removable Movements #1 and/or #2. In addition, methods for attaching a removable grip to a shaft by implementing one or more of the Movements or Removable Movements are also contemplated.

Similarly, methods for removing the removable grip from a shaft are also contemplated. The following is a discussion on the actions to remove grip 2 to a shaft 4. Removing grip 2 from shaft 4 may, in some embodiments, include one (1) to two (2) movements, designated Removable Movement #1 and, if needed, Removable Movement #2, which are essentially the reverse actions of Securing Movements #2 and #1 (if required) discussed hereinabove.

Removable Rotational Movement #1 is the first step in removing grip 2 from shaft 4 and is, in some embodiments, loosening the tension in toe components 36. This is said to be the reversed movements of Toe Securing Method A or Toe Securing Method B, whichever is used in the particular embodiment.

When Toe Securing Method A was used, the toe components 36 relating to Toe Securing Method A must first be released from shaft 4. In order to do this, elongated flexible strap 25 is released from embedded securing surface 27 (e.g., loosened) from both lower, distal portion of grip 2 and shaft 4. By releasing the securing surface 27 embedded into the surface of the elongated flexible strap 25, the torque compression applied at the lower, distal portion of gripping sleeve 2 is loosened. This releases toe components 36 and also breaks the tension and reverses the compression force that was holding the core 5 of gripping sleeve 2 against the shaft 4 (see, e.g., FIGS. 10*a*, 10*b*, 11*a* and 11*b*).

When Toe Securing Method B was used, the toe components 36 relating to Toe Securing Method B must first be released from shaft 4. In order to do this, flange lock sleeve 28 must be untwisted or unscrewed (i.e., loosened) from flange collet 30, which releases the surface contact of flange housing 26 with shaft 4. This releases toe components 36 from shaft 4, allowing grip 2 to be completely removed from shaft 4 (see, e.g., FIGS. 13*a*, 13*b*, 14*a*, and 14*b*).

If Heel Securing Method B and Heel Securing Method C were used to attach grip 2, release of grip 2 from shaft 4 does not require another movement, but requires simply the force required to remove the whole grip 2 (e.g., upwards) off the shaft 4, as long as toe components 36, are released first (order of operation). Thus, if Heel Securing Method B and C are in place in the upper, proximal portion of grip 2, grip 2 would than assume its relaxed configuration and would be configured to be pulled completely free from shaft 4 in the opposite direction with little to no force required as shown in, for example, FIGS. 6*a* and 7*a*.

However, if Heel Securing Method A, in which heel components 34 comprise, for example, five (5) separate parts illustrated in FIGS. 5*a* and 5*b*, was used to attach grip 2, there is an additional step, which is the reverse movements to that of said securing method, namely Removable Rotational Movement #2 discussed hereinbelow.

Removable Rotational Movement #2 is, in the embodiments where Heel Securing Method A was used, the final step in removing grip 2 from shaft 4. Removable Rotational Movement #2 is the loosening of the tension in heel components 34 when grip 2 is in the torqued (e.g., tightened) configuration by, for example, untwisting (e.g., loosening) grip cap 8 and lead screw 12 located at the proximal end of grip 2 in a direction opposite to the direction used to tighten heel components 34 onto shaft 4. This will release the tension in heel components 34 by causing expandable tube 20 within shaft 4 to decompress (e.g., relax) and pull away from shaft 4, thereby breaking the connection of heel components 34 from shaft 4. In addition, twisting grip cap 8 allows said the grip sleeve of grip 2 to be released from the torqued configuration into the relaxed configuration as shown in, for example, FIGS. 5*a* and 5*b*. Gripping sleeve 2 will then be configured to be pulled completely free from shaft 4 in the opposite direction with little to no force required as shown in, for example, FIGS. 5*a* and 5*b*.

Figure 34:
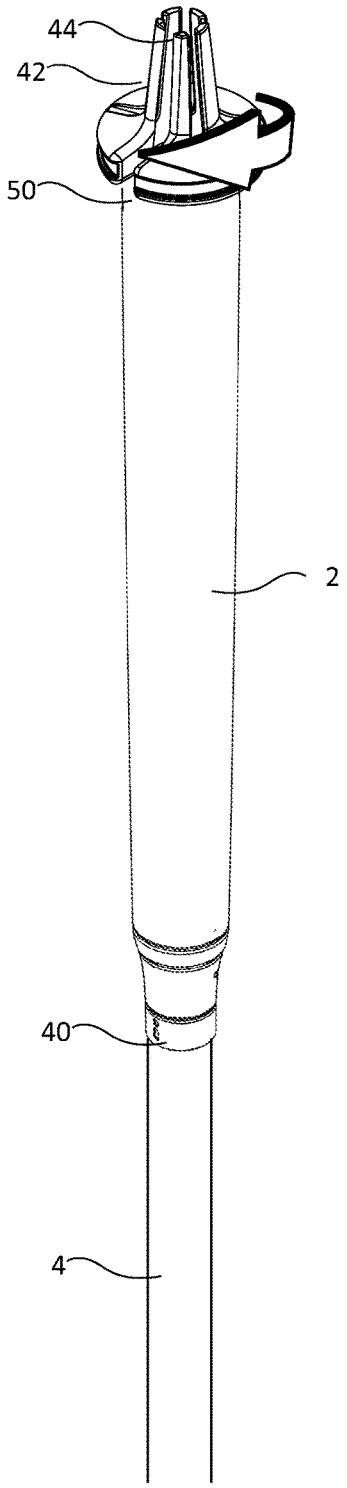
FIG. 34 is a perspective view of the securing tool attached to the upper, distal portion of the grip sleeve during the release of the Heel Securing Method D, according to the aspects of the certain embodiments of the present invention.
Figure 35:
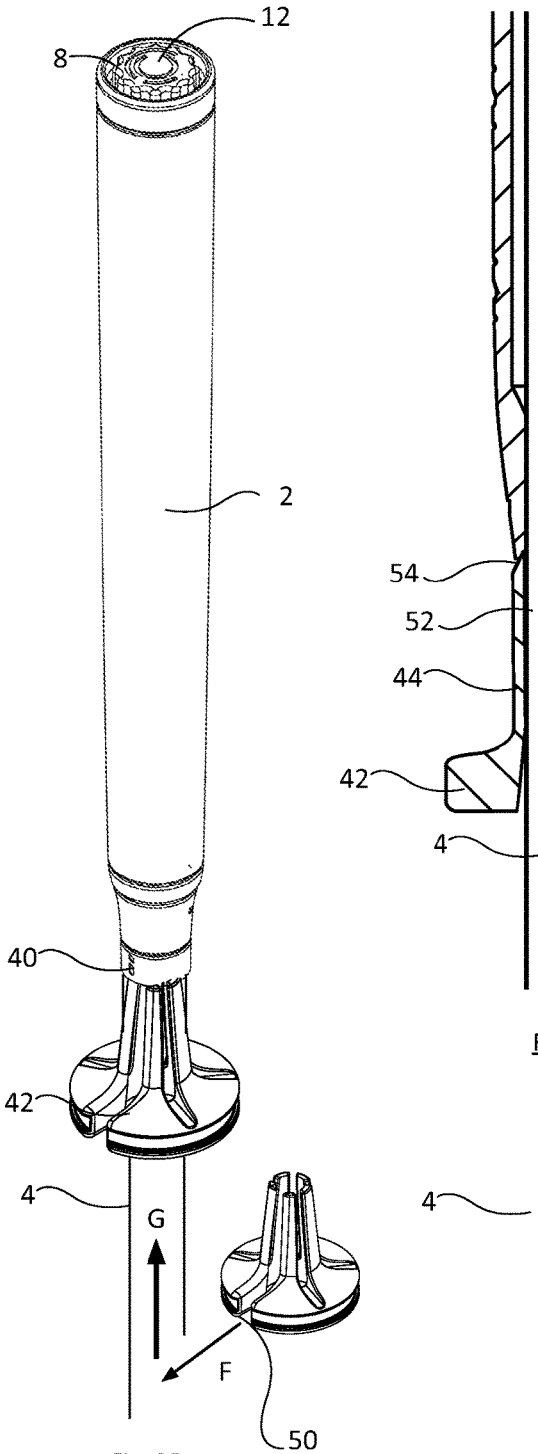
FIG. 35 is a perspective view of the securing tool attached to the lower, proximal portion of the grip sleeve during the release of Toe Securing Method C, according to aspects of certain embodiments of the present invention.
Figure 36:
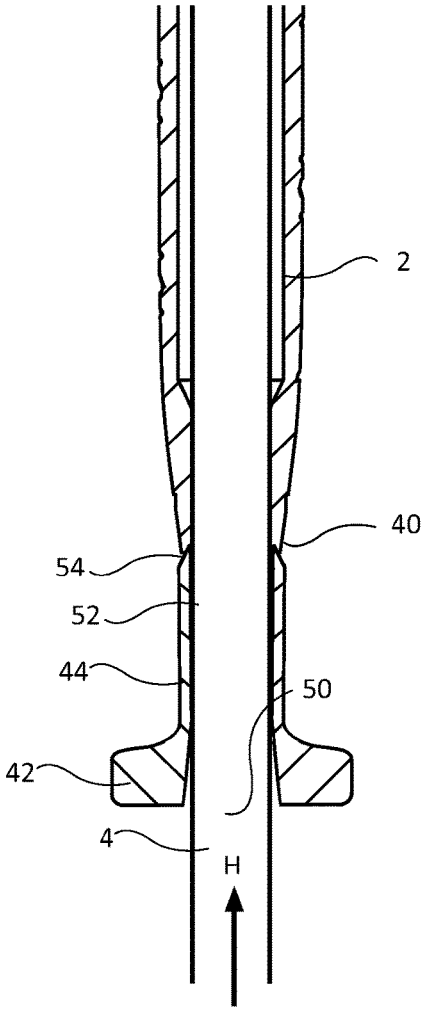
FIG. 36 is a cross-sectional view of the securing tool attached to the lower, proximal portion of the grip sleeve and the shaft during the release of Toe Securing Method C.

If Heel Securing Method A is used along with Toe Securing Method C, in addition with use of securing tool 42, as illustrated in FIGS. 34, 35 and 36, it is suggested that the first Movement #2 is, in the embodiments where Heel Securing Method A was used, the first step of removing grip 2 from shaft 4. Removable Rotational Movement #2 is the loosening of the tension in heel components 34 when grip 2 is in the torqued (e.g., tightened) configuration by, for example, using securing tool 42 to untwist (e.g., loosen) grip cap 8 and lead screw 12, located at the proximal end of grip 2, in a direction opposite to the direction used to tighten heel components 34 onto shaft 4, as illustrated in FIG. 34. This will release the tension in heel components 34 by causing expandable tube 20 within shaft 4 to decompress (e.g., relax) and pull away from shaft 4, thereby breaking the connection of heel components 34 from shaft 4. In addition, twisting grip cap 8 allows the grip sleeve 2 to be released from the torqued configuration into the relaxed configuration as shown in, for example, FIGS. 30 and 32.

The second removable motion involves attaching securing tool 42 onto lower, distal portion of shaft 4, by inserting shaft 4 through the split opening 50 in the direction of arrow F, as illustrated in FIG. 35, and then sliding securing tool 42 vertically up the shaft 4 in the direction of arrow G and forcing the tapered ends 54 of prongs 44 into the Reduced Diameter Sleeve 40 of the lower, distal portion of the grip 2 in the direction of arrow H, as illustrated in FIG. 36. At this point, grip 2 will then be configured to be pulled completely off the end of shaft 4 in the opposite direction with little to no force required as shown in, for example, FIGS. 35 and 36.

Different embodiments are disclosed herein. Features of certain embodiments may be combined with features of other embodiments; thus certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

PARTS LIST (2) Grip
(3) Complete Golf Club
(4) Shaft
(5) Core Design
(6) Golf Club Head
(8) Heel—Grip Cap
(12) Heel—Lead Screw
(14) Ratchet Paw Housing
(16) Heel—Ratchet Gear (Heel Securing Method A)
(17) Ratchet Paws (Heel Securing Method A)
(18) Heel—Ratchet Gear Hub (Heel Securing Method A)
(19) Heel—Tapered Helix Insert (Heel Securing Method B)
(20) Heel—Expandable Tube (Heel Securing Method A)
(21) Heel—Multi Star Spring Nut (Heel Securing Method C)
(22) Heel—Compression Nut (Heel Securing Method A)
(25) Toe—Elongated Flexible Strap (Toe Securing Method A)
(26) Toe—Flange Housing (Toe Securing Method B)
(27) Toe—Securing Surface (Toe Securing Method A)
(28) Toe—Threaded Flange Lock Sleeve (Toe Securing Method B)
(29) Tapered Helix Insert arms (Heel Securing Method B)
(30) Toe—Threaded Flange Collet (Toe Securing Method B)
(31) Multi Star Spring Nut wall (Heel Securing Method C)
(34) Embodiment of all heel components
(36) Embodiment of all toe components
(40) Toe—Reduced Diameter Sleeve
(42) Securing Tool
(44) Securing tool—Flexible Prongs
(46) Securing tool—base/gripping surface
(47) Securing tool—Internal Rim
(48) Securing tool—Spline Teeth
(50) Securing tool—Split Opening
(52) Securing tool—Prongs Internal Protruding Spline
(54) Securing tool—Prongs Tapered Ends

The invention claimed is:

1. A removable grip system comprising:

a grip configured for attaching onto a hollow golf club shaft at a handle region thereof, the grip comprising:

an annular, longitudinal sleeve comprising an upper sleeve portion, a lower sleeve portion, and a medial sleeve portion between the upper and lower sleeve portions;

a first grip component at the upper sleeve portion of the grip, said first grip component configured to be secured onto the golf club shaft at a first portion of the handle region, said first grip component comprising a grip cap comprising a first plurality of spline teeth;

a second grip component at the lower sleeve portion of the grip, said second grip component configured to be secured onto the golf club shaft at a second portion of the handle region;

wherein the medial portion of the longitudinal sleeve is configured to rotate in a first direction radially about the shaft between the secured first and second grip components thereby tightening the medial portion onto the shaft by decreasing an internal diameter of the medial portion; and a securing tool configured to assist attaching the grip onto the hollow golf club shaft, the securing tool comprising:

a base comprising an upper base portion, a lower base portion, and a gap opening, said gap opening configured to allow said securing tool to be inserted onto the hollow golf club shaft;

a first functional end at the lower base portion, said first functional end comprising a second plurality of spline teeth, wherein the second plurality of spline teeth on the securing tool is configured to engage with the first plurality of spline teeth of the grip cap on the first grip component such that rotating the securing tool also rotates the grip cap; and a second functional end at the upper base portion, said second functional end comprising a plurality of projections extending outward from the upper base portion, said plurality of projections configured to engage with the second grip component.

2. The removable grip system of claim 1, wherein the grip further comprises a ratchet paw housing, said ratchet paw housing comprising a ratchet gear arranged co-axially with the longitudinal sleeve, and said grip further comprising at least one radially extending ratchet arm extending from an internal diameter of the longitudinal sleeve towards the ratchet gear, said at least one radially extending ratchet arm configured to engage with teeth of the ratchet gear, wherein rotation of the medial portion in the first direction radially causes the at least one radially extending ratchet arm to engage successive teeth of the ratchet gear.

3. The removable grip system of claim 2, wherein, upon rotating the medial portion of the longitudinal sleeve in the first direction causes the at least one radially extending ratchet arm to engage successive teeth of the ratchet gear.

4. The removable grip system of claim 2, wherein the ratchet gear is mounted to the shaft.

5. The removable grip system of claim 2, wherein the engagement between the at least one radially extending ratchet arm and the ratchet gear teeth prevents backward rotation of the medial portion relative to the outer surface of the golf club shaft.

6. The removable grip system of claim 2, wherein the first grip component comprises a compression nut and an expandable tube, wherein the ratchet gear is mounted to the compression nut and the expandable tube.

7. The removable grip system of claim 1, wherein the first grip component comprises a compression nut and an expandable tube.

8. The removable grip system of claim 7, wherein the compression nut and the expandable tube are configured to be inserted into the hollow golf club shaft at the first portion of the handle region.

9. The removable grip system of claim 7, wherein the first grip component further comprises a screw threaded through the compression nut and the expandable tube, wherein the screw is configured to be turned using a rotational torque thereby expanding the expandable tube against an internal surface of the hollow golf club shaft under pressure from the compression nut.

10. The removable grip system of claim 9, wherein an end cap is attached to the screw.

11. The removable grip system of claim 1, wherein the longitudinal sleeve comprises a material that, upon twisting of the medial portion, is configured to decrease the internal diameter of the longitudinal sleeve thereby tightening the longitudinal sleeve onto the hollow golf club shaft.

12. The removable grip system of claim 1, wherein the longitudinal sleeve comprises a textured internal surface that is configured to increase the frictional force between the internal surface of the longitudinal sleeve and an outer surface of the hollow golf club shaft.

13. The removable grip system of claim 12, wherein the textured internal surface prevents backward rotation of the longitudinal sleeve relative to the outer surface of the hollow golf club shaft.

14. The removable grip system of claim 1, wherein the medial portion has a relaxed configuration when the internal diameter of the medial portion is not tight around the hollow golf club shaft and a secured configuration when the internal diameter of the medial portion is decreased and is tight around the hollow golf club shaft, and wherein tightening the medial portion onto the hollow golf club shaft comprises changing the medial portion from the relaxed configuration to the secured configuration.

15. The removable grip system of claim 14, wherein the medial portion is maintained in the relaxed configuration until after both the first grip component and the second grip component are secured onto the golf club shaft.

16. The removable grip system of claim 1, wherein each of the plurality of projections of the second functional end comprises a proximal end and a distal end, and each is angled inward relative to the base from the proximal end the distal end.

17. The removable grip system of claim 1, wherein each of the plurality of projections of the second functional end comprises a proximal end and a distal end, and each is tapered such that the proximal end is larger than the distal end.

18. The removable grip system of claim 1, wherein each of the plurality of projections of the second functional end comprises at least one protruding spline extending inward relative to the base.

19. The removable grip system of claim 1, wherein the second grip component at the lower sleeve portion of the grip comprises a first internal diameter smaller than an external diameter of the hollow golf club shaft and a second internal diameter larger than the external diameter of the hollow golf club shaft, and wherein the plurality of projections of the second functional end of the securing tool are configured for insertion into the second grip component such that the first internal diameter of the second grip component is expanded to the second internal diameter when the grip is installed onto the hollow golf club shaft.

20. A removable grip apparatus comprising:

a grip configured for attaching onto a hollow golf club shaft at a handle region thereof, the grip comprising:

an annular, longitudinal sleeve comprising an upper sleeve portion, a lower sleeve portion, and a medial sleeve portion between the upper and lower sleeve portions;

a first grip component at the upper sleeve portion of the grip, said first grip component configured to be secured onto the golf club shaft at a first portion of the handle region, said first grip component comprising a grip cap comprising a first plurality of spline teeth, wherein the first plurality of spline teeth on the grip cap is engaged with a second plurality of spline teeth on a securing tool, wherein engagement of the first plurality of spline teeth with the second plurality of spline teeth allows rotating the grip cap by rotating the securing tool;

a second grip component at the lower sleeve portion of the grip, said second grip component configured to be secured onto the golf club shaft at a second portion of the handle region;

wherein the medial portion of the longitudinal sleeve is configured to rotate in a first direction radially about the shaft between the secured first and second grip components thereby tightening the medial portion onto the shaft by decreasing an internal diameter of the medial portion.

21. A removable grip system comprising:

a grip configured for attaching onto a hollow golf club shaft at a handle region thereof, the grip comprising:

an annular, longitudinal sleeve comprising an upper sleeve portion, a lower sleeve portion, and a medial sleeve portion between the upper and lower sleeve portions;

a first grip component at the upper sleeve portion of the grip, said first grip component configured to be secured onto the golf club shaft at a first portion of the handle region;

a second grip component at the lower sleeve portion of the grip, said second grip component configured to be secured onto the golf club shaft at a second portion of the handle region, said second grip component comprising a first internal diameter smaller than an external diameter of the hollow golf club shaft and a second internal diameter larger than the external diameter of the hollow golf club shaft, wherein the second grip component is engaged with a plurality of projections extending outward from a securing tool, wherein engagement of the plurality of projections on the securing tool allows expansion of the second grip component from the first internal diameter to the second internal diameter configuring the lower sleeve portion of the grip for insertion on the hollow golf club shaft over the external diameter thereof;

wherein the medial portion of the longitudinal sleeve is configured to rotate in a first direction radially about the shaft between the secured first and second grip components thereby tightening the medial portion onto the shaft by decreasing an internal diameter of the medial portion.

* * * * *